US009026007B2

(12) United States Patent
Bisaiji et al.

(10) Patent No.: US 9,026,007 B2
(45) Date of Patent: May 5, 2015

(54) IMAGE FORMING APPARATUS

(71) Applicants: Takashi Bisaiji, Kanagawa (JP); Hiroomi Tamura, Kanagawa (JP); Hirokatsu Suzuki, Kanagawa (JP); Satoru Ishikake, Kanagawa (JP); Ryuji Yoshida, Kanagawa (JP)

(72) Inventors: Takashi Bisaiji, Kanagawa (JP); Hiroomi Tamura, Kanagawa (JP); Hirokatsu Suzuki, Kanagawa (JP); Satoru Ishikake, Kanagawa (JP); Ryuji Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 114 days.

(21) Appl. No.: 13/716,371

(22) Filed: Dec. 17, 2012

(65) Prior Publication Data

US 2013/0156466 A1 Jun. 20, 2013

(30) Foreign Application Priority Data

Dec. 19, 2011 (JP) ..... 2011-276700
Sep. 6, 2012 (JP) ..... 2012-196669

(51) Int. Cl.
*G03G 15/01* (2006.01)
*G03G 15/00* (2006.01)
*G03G 21/20* (2006.01)

(52) U.S. Cl.
CPC ..... *G03G 21/20* (2013.01); *G03G 15/0126* (2013.01)

(58) Field of Classification Search
USPC ..... 399/94, 107, 111, 119, 223
See application file for complete search history.

(56) References Cited

U.S. PATENT DOCUMENTS

| | | | | |
|---|---|---|---|---|
| 4,246,332 | A | 1/1981 | Tanaka et al. | |
| 6,519,422 | B1 | 2/2003 | Takeda et al. | |
| 2003/0219670 | A1 | 11/2003 | Sawada et al. | |
| 2007/0184377 | A1 | 8/2007 | Shu et al. | |
| 2010/0310980 | A1 * | 12/2010 | Sugimoto et al. | 430/108.2 |

FOREIGN PATENT DOCUMENTS

| | | |
|---|---|---|
| JP | 59-050060 | 12/1984 |
| JP | 2003-084497 | 3/2003 |
| JP | 3636633 | 1/2005 |
| JP | 2010-091787 | 4/2010 |
| JP | 2011-008108 | 1/2011 |

OTHER PUBLICATIONS

Koji Hirakura et al., Electrophotography, Jun. 20, 2008, Tokyo Denki University Press, pp. 78-96 partial translation pp. 90-96.
Manabu Takeuchi et al., Chemical Toner, Nov. 30, 2008, Tokyo Denki University Press, pp. 156-160.

* cited by examiner

*Primary Examiner* — Hoang Ngo
(74) *Attorney, Agent, or Firm* — Harness, Dickey & Pierce

(57) ABSTRACT

An image forming apparatus comprising: a plurality of housing units that houses toners of mutually different colors, at least one toner inside of the plurality of housing units being to be used for forming a toner image on a recording medium; and a fixing unit configured to fix the toner image on the recording medium to the recording medium, wherein a housing unit among the plurality of housing units that houses a toner with a lowest peak temperature of loss elastic modulus is disposed in a portion with a lower temperature than a temperature of a portion where another housing unit is disposed, or in a position farther from the fixing unit than a portion where another housing unit is disposed.

17 Claims, 8 Drawing Sheets

IMAGE FORMING APPARATUS

CROSS-REFERENCE TO RELATED APPLICATIONS

The present application claims priority to and incorporates by reference the entire contents of Japanese Patent Application No. 2011-276700 filed in Japan on Dec. 19, 2011 and Japanese Patent Application No. 2012-196669 filed in Japan on Sep. 6, 2012.

BACKGROUND OF THE INVENTION

1. Field of the Invention

The present invention relates to an image forming apparatus such as a copying machine, a printer, and a facsimile.

2. Description of the Related Art

Conventionally, an electrophotographic image forming apparatus typified by Carlson's process is known. This image forming apparatus evenly charges a photosensitive element with a photoconductive characteristic to form a latent image as a charge distribution by image exposure corresponding to an image pattern. Subsequently, the image forming apparatus visualizes an image using colored resin microparticles (hereinafter referred to as toner) that are charged positively or negatively. Subsequently, an electrostatic force allows the toner to be transferred and moved onto a surface of a transferring material typified by a decalcomania paper. The transferring material passes through between pressed rollers. This allows obtaining a final toner image by fixing the toner on the transferring material using elasticity of the toner.

Japanese Patent Application Laid-open No. and Japanese Patent Application Laid-open No. 2003-84497 disclose image forming apparatuses that employ low temperature fixing using toner with a low peak temperature of loss elastic modulus.

Nowadays, a full-color image forming apparatus becomes mainstream using toners of four colors of black (hereinafter referred to as K), cyan (hereinafter referred to as C), magenta (hereinafter referred to as M), and yellow (hereinafter referred to as Y). Material applicable to toner of each color has been examined.

The full-color image forming apparatus is preferred to employ toners of the respective colors that each have approximately the same value of the peak temperature of loss elastic modulus. The loss elastic modulus is a measure of energy quantity where a stress applied to a toner is dissipated as heat at a deformation. The reason why the toners of the respective colors each have approximately the same value of the peak temperature of loss elastic modulus are used is as follows. This allows fixing the respective colors at the same fixing temperature and easily determining fixing temperatures. However, even if a toner that has a low peak temperature of loss elastic modulus and is easily softened and melted is developed, a toner of a certain color may be manufactured while a toner of another color might not be manufactured as follows. For example, matching of colorant (pigment and dye) causes a problem in a toner manufacturing process. As a result, manufacturing all the toners of four colors of K, C, M, and Y as toners with low values of peak temperature of loss elastic modulus has been difficult.

However, radiant heat of a fixing device and heat of a driving motor that drives, for example, a photosensitive element increases a temperature of a specific developing device that houses the toner with a low peak temperature of loss elastic modulus. In this specific developing device, the toner with a low peak temperature of loss elastic modulus is softened and condenses into a lump, which is blocking. The occurrence of blocking has been a problem.

The present invention has been made in view of the above-described circumstances, and it is an object of the present invention to provide an image forming apparatus that prevents blocking from occurring inside of a housing unit where a toner with a low peak temperature of loss elastic modulus is housed.

SUMMARY OF THE INVENTION

It is an object of the present invention to at least partially solve the problems in the conventional technology.

An image forming apparatus comprising: a plurality of housing units that houses toners of mutually different colors, at least one toner inside of the plurality of housing units being to be used for forming a toner image on a recording medium; and a fixing unit configured to fix the toner image on the recording medium to the recording medium, wherein a housing unit among the plurality of housing units that houses a toner with a lowest peak temperature of loss elastic modulus is disposed in a portion with a lower temperature than a temperature of a portion where another housing unit is disposed.

An image forming apparatus comprising: a plurality of housing units that houses toners of mutually different colors, at least one toner inside of the plurality of housing units being to be used for forming a toner image on a recording medium; and a fixing unit configured to fix the toner image on the recording medium to the recording medium, wherein a housing unit among the plurality of housing units houses a toner with a lowest peak temperature of loss elastic modulus is disposed in a position farther from the fixing unit than a portion where another housing unit is disposed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a description will be given of one embodiment where the present invention is applied to a printer as an image forming apparatus that forms an image using electrophotography.

First, a description will be given of a basic configuration of the printer according to the embodiment.

Figure 1:
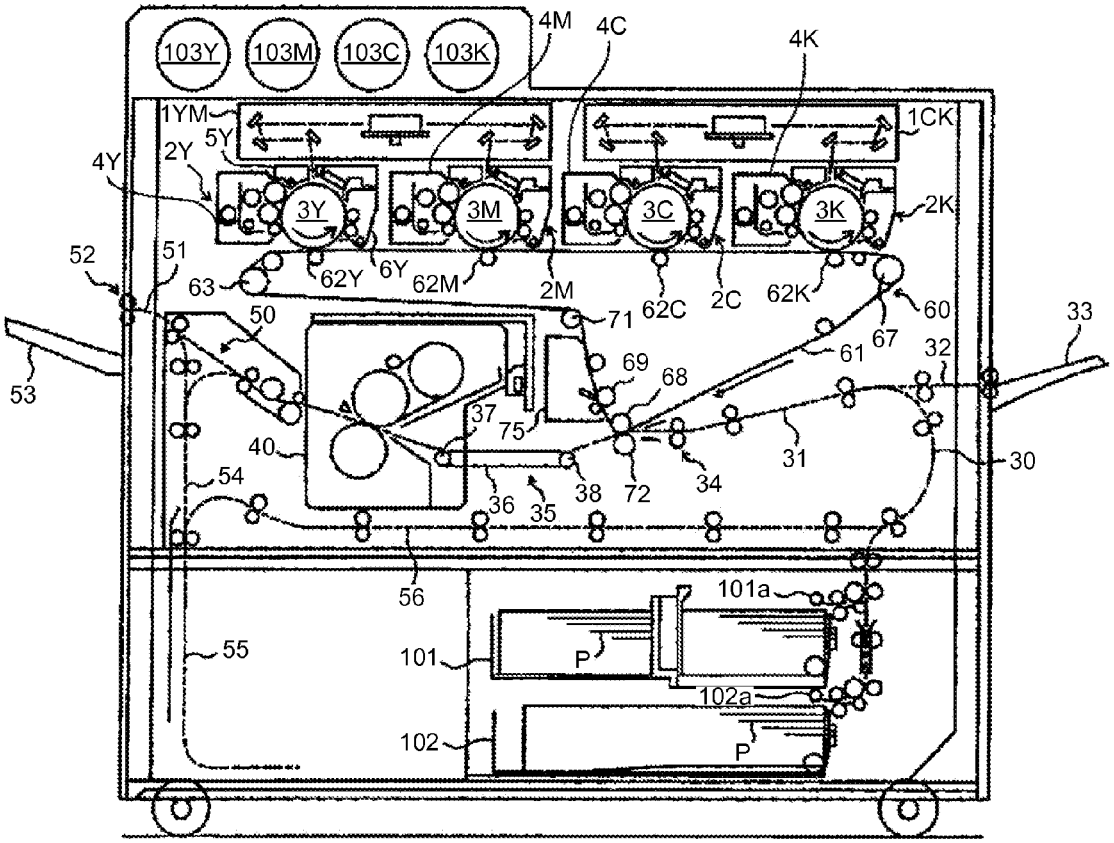
FIG. 1 is a schematic configuration diagram of an exemplary printer.

FIG. 1 is a schematic configuration diagram illustrating an exemplary printer according to the embodiment.

This printer includes two optical writing units 1YM and 1CK and four process units 2Y, 2M, 2C, and 2K to form toner images of yellow (Y), magenta (M), cyan (C), and black (K). The printer also includes a feed path 30, a pre-transfer conveying path 31, a bypass feeding path 32, a bypass tray 33, a pair of registration rollers 34, a conveying belt unit 35, a fixing device 40, a conveyance switching device 50, a discharging path 51, a pair of ejecting rollers 52, a discharge tray 53, a first paper cassette 101, a second paper cassette 102, a refeeding device, and similar member.

The first paper cassette 101 and the second paper cassette 102 each house a bundle of recording sheets P inside as a recording medium. Then, paper feeding rollers 101*a* and 102*a* are rotatably driven to send out a recording sheet P on the top of the paper bundle to the feed path 30. This feed path 30 is continuous with the pre-transfer conveying path 31 that is used for conveying the recording sheet immediately before a secondary transfer nip described below. The recording sheet P sent out from the paper cassettes 101 and 102 goes into the pre-transfer conveying path 31 via the feed path 30.

On a side surface of a printer housing, the bypass tray 33 is disposed to be openable and closable with respect to the housing. In a state where the bypass tray 33 is open with respect to the housing, a paper bundle is manually fed on the top surface of the tray. A recording sheet P on the top of the paper bundle, which is manually fed, sent out to the pre-transfer conveying path 31 by a delivery roller of the bypass tray 33.

The two optical writing units 1YM and 1CK each include a laser diode, a polygon mirror, various lenses, and similar member. The laser diode is driven based on image information read by a scanner outside of the printer and image information sent from a personal computer. Subsequently, the optical writing units 1YM and 1CK scan photosensitive elements 3Y, 3M, 3C, and 3K as latent image carriers of the process units 2Y, 2M, 2C, and 2K with a light. Specifically, the photosensitive elements 3Y, 3M, 3C, and 3K of the process units 2Y, 2M, 2C, and 2K are each rotatably driven in a counterclockwise direction in the drawing by a driving unit (not shown). The optical writing unit 1YM irradiates laser beams on the photosensitive elements 3Y and 3M being driven while deflecting each laser beam in a rotation axis line direction, thus performing an optical scanning process. This forms an electrostatic latent image on the photosensitive element 3Y and the photosensitive element 3M respectively based on Y image information and M image information. The optical writing unit 1CK irradiates laser beams on the photosensitive elements 3C and 3K being driven while deflecting each laser beam in a rotation axis line direction, thus performing an optical scanning process. This forms an electrostatic latent image on the photosensitive element 3C and the photosensitive element 3K respectively based on C image information and K image information.

The process units 2Y, 2M, 2C, and 2K include the respective photosensitive elements 3Y, 3M, 3C, and 3K in shapes of drums as latent image carriers. The process units 2Y, 2M, 2C, and 2K each include various pieces of equipment as one unit that is disposed in peripheral areas of the respective photosensitive elements 3Y, 3M, 3C, and 3K, and are held by a common supporting member. These units are removable from a printer main body. The respective process units 2Y, 2M, 2C, and 2K have mutually different colors of toners to be used, and are otherwise similar to one another. For example, the process unit 2Y for Y includes a developing device 4Y other than the photosensitive element 3Y. The developing device 4Y is used to develop an electrostatic latent image formed on the surface of the photosensitive element 3Y to have a Y toner image. The process unit 2Y for Y also includes a charging device 5Y, a drum cleaning device 6Y, and similar member. The charging device 5Y evenly performs a charging process on the surface of the photosensitive element 3Y, which is rotatably driven. The drum cleaning device 6Y cleans remaining toner after transfer attached on the surface of the photosensitive element 3Y after passing through a primary transfer nip for Y, which is described below.

The printer illustrated in the drawing has what is called a tandem configuration where the four process units 2Y, 2M, 2C, and 2K are arranged along an endless moving direction of an intermediate transfer belt 61, which is described below.

This configuration employs a drum-shaped member where a photosensitive layer is formed by applying an organic sensitive material with photosensitivity over an element tube made of, for example, aluminum. However, the photosensitive element 3Y may employ a member in an endless belt shape.

The developing device 4Y develops a latent image using a two-component developer (hereinafter referred to as simply a "developer") that includes a magnetic carrier and a non-magnetic Y toner (not shown). The developing device 4Y may be a developing device that develops one-component developer without the magnetic carrier instead of the two-component developer. A Y toner replenishment unit (not shown) replenishes the developing device 4Y with the Y toner inside of a Y toner bottle 103Y as necessary.

The drum cleaning device 6Y employs a system where a cleaning blade, which is made of cleaning material of polyurethane rubber, is pressed to the photosensitive element 3Y. The drum cleaning device 6Y may employ another system. In order to improve cleaning ability, this printer employs a system where a rotatable fur brush is abutted on the photosensitive element 3Y. This fur brush also scrapes off lubricant from solid lubricant (not shown) to have fine powders to be applied over the surface of the photosensitive element 3Y.

A neutralization lamp (not shown) is disposed above the photosensitive element 3Y. This neutralization lamp is also a part of the process unit 2Y. The neutralization lamp removes electricity on the surface of the photosensitive element 3Y after passing through the drum cleaning device 6Y using light irradiation. The surface of the photosensitive element 3Y where electricity is removed is evenly charged by the charging device 5Y, and then scanned with a light by the above-described optical writing unit 1YM. The charging device 5Y rotatably drives while receiving charge bias supplied from an electric power supply (not shown). Instead of this system, a scorotron charger system, which performs a charging process on the photosensitive element 3Y without any contact, may be employed.

The process unit 2Y for Y has been described above. The process units 2M, 2C, and 2K for M, C, and K each have a configuration similar to that for Y.

A transferring unit 60 is disposed below the four process units 2Y, 2M, 2C, and 2K. This transferring unit 60 brings the intermediate transfer belt 61 in contact with the photosensitive elements 3Y, 3M, 3C, and 3K. The intermediate transfer belt 61 is an endless belt that is stretched by a plurality of supporting rollers 63, 67, 69, 71, and the rest. In this state, the transferring unit 60 makes the intermediate transfer belt 61 to run (endlessly move) in a clockwise direction in the drawing by rotation driving of any one of the supporting rollers. This forms primary transfer nips for Y, M, C, and K where the photosensitive elements 3Y, 3M, 3C, and 3K abut on the intermediate transfer belt 61.

At the proximity of the primary transfer nips for Y, M, C, and K, primary transfer rollers 62Y, 62M, 62C, and 62K are disposed in a space surrounded by an inner peripheral surface of the intermediate transfer belt, that is, in a belt loop. The primary transfer rollers 62Y, 62M, 62C, and 62K as primary transfer members press the intermediate transfer belt 61 toward the photosensitive elements 3Y, 3M, 3C, and 3K. Respective primary transfer biases are applied to these primary transfer rollers 62Y, 62M, 62C, and 62K by an electric power supply (not shown). This forms a primary transfer electric field in the primary transfer nips for Y, M, C, and K that electrostatically moves the toner images of the photosensitive elements 3Y, 3M, 3C, and 3K toward the intermediate transfer belt 61.

In accordance with the endless movement in the clockwise direction in the drawing, toner images sequentially overlap in the respective primary transfer nips to perform a primary transfer on an outer peripheral surface of the intermediate transfer belt 61 that sequentially passes the primary transfer nips for Y, M, C, and K. This overlapping of the primary transfer forms a four-color overlapped toner image (hereinafter referred to as "a four-color toner image") on the outer peripheral surface of the intermediate transfer belt 61.

A secondary transfer roller 72 as a secondary transfer member is disposed below the intermediate transfer belt 61 in the drawing. This secondary transfer roller 72 abuts on a portion around a secondary transfer backup roller 68 in the intermediate transfer belt 61 from the belt outer peripheral surface so as to form a secondary transfer nip. This forms a secondary transfer nip where the outer peripheral surface of the intermediate transfer belt 61 contacts the secondary transfer roller 72.

A secondary transfer bias is applied to the secondary transfer roller 72 by an electric power supply (not shown). On the other hand, the secondary transfer backup roller 68 inside of the belt loop is grounded. This forms a secondary transfer electric field in the secondary transfer nip.

The above-described pair of registration rollers 34 is disposed on the right side of the secondary transfer nip in the drawing. The pair of registration rollers 34 sends out a recording sheet P, which is sandwiched between the rollers, to the secondary transfer nip at a timing that allows synchronizing the four-color toner image on the intermediate transfer belt 61. In the secondary transfer nip, the four-color toner image on the intermediate transfer belt 61 is collectively transferred on the recording sheet P using the secondary transfer by influences of the secondary transfer electric field and nip pressure. This forms a full color image while the four-color toner image is mixed with white of the recording sheet P.

On the outer peripheral surface of the intermediate transfer belt 61 that has passed the secondary transfer nip, remaining toner after transfer is attached. The remaining toner is the toner that has not been transferred to the recording sheet P in the secondary transfer nip. This remaining toner after transfer is cleaned by a belt cleaning device 75 abutting on the intermediate transfer belt 61.

The recording sheet P that has passed the secondary transfer nip is separated from the intermediate transfer belt 61 to be handed over to the conveying belt unit 35. This conveying belt unit 35 endlessly moves a conveying belt 36 in an endless belt shape in the counterclockwise direction in the drawing by rotation driving of a drive roller 37 while stretching a conveying belt 36 using the drive roller 37 and a driven roller 38. Subsequently, the conveying belt unit 35 holds the recording sheet P, which has been handed over from the secondary transfer nip, on the stretched outer peripheral surface of the conveying belt. The conveying belt unit 35 concurrently conveys the recording sheet P in accordance with the endless movement of the conveying belt 36 to hand over the recording sheet P to the fixing device 40 as a fixing unit.

In this printer, the conveyance switching device 50, a refeeding path 54, a reverse feed path 55, a conveying path after reverse feed 56, and similar member constitute a refeeding unit. Specifically, the conveyance switching device 50 switches a subsequent conveyance destination of the recording sheet P received from the fixing device 40 using the discharging path 51 and the refeeding path 54. When executing a print job in one-sided mode, which forms an image only on a first surface of the recording sheet P, the conveyance destination of the recording sheet P is set to the discharging path 51. This sends the recording sheet P where the image is formed only on the first surface to the pair of ejecting rollers 52 via the discharging path 51, and then discharges the recording sheet P onto the discharge tray 53 outside of the machine. Two-sided mode forms respective images on both surfaces of the recording sheet P. In the execution of a print job in this mode, the conveyance destination of the recording sheet P is also set to the discharging path 51 when the recording sheet P where the respective images are fixed on the both surfaces is received from the fixing device 40. This discharges the recording sheet P where the images are formed on the both surfaces to the discharge tray 53 outside of the machine. On the other hand, in the execution of the print job in two-sided mode, the conveyance destination of the recording sheet P is set to the refeeding path 54 when the recording sheet P where an image is fixed only on the first surface is received from the fixing device 40.

The refeeding path 54 is coupled to the reverse feed path 55. The recording sheet P sent to the refeeding path 54 goes into the reverse feed path 55. Subsequently, when all regions of the recording sheet P in the conveying direction goes into the reverse feed path 55, the conveying direction of the recording sheet P is reversed so as to reversely feed the recording sheet P. The reverse feed path 55 is coupled to the conveying path after reverse feed 56 in addition to the refeeding path 54. The recording sheet P, which is reversely fed, goes into the conveying path after reverse feed 56. At this time, the top and bottom of the recording sheet P are reversed. Subsequently, the recording sheet P where the top and bottom are reversed is re-fed to the secondary transfer nip via the conveying path after reverse feed 56 and the feed path 30. The recording sheet P where a toner image is also transferred on a second surface in the secondary transfer nip is discharged to the discharge tray 53 via the conveyance switching device 50, the discharging path 51, and the pair of ejecting rollers 52 after the toner image is fixed on the second surface via the fixing device 40.

This printer has a full-color image forming mode and a black and white image forming mode. The full-color image forming mode forms an image using four-color toners with colors of K, C, M, and Y. The monochrome image forming mode forms an image using, for example, the K toner only. These are arbitrarily selected by a user through an operating unit of a device or a print screen of a PC.

In the case where the full-color image forming mode is selected, the four process units 2Y, 2M, 2C, and 2K form toner images on the photosensitive elements corresponding to respective pieces of image information. Sequentially, the toner images are transferred to the intermediate transfer belt 61, and then collectively transferred onto a decalcomania paper by paper transfer. Subsequently, a process that melts and fixes the toner image using a fixing belt is performed. In the case where the monochrome image forming mode using K only is performed, the process unit 2K where image data relates to a K image only is operated. An image is obtained by a process similar to the full-color image forming mode after the transfer to the intermediate transfer belt 61.

Toner bottles 103Y, 103M, 103C, and 103K are disposed above the optical writing unit 1YM, and are disposed as toner containers where toners with respective colors of yellow, magenta, cyan, and black are filled. The toner bottles 103Y, 103M, 103C, and 103K are removably disposed on a device main body. A toner replenishment unit, which is described below, replenishes a predetermined replenishment amount of the toners with the respective colors of yellow, cyan, magenta, and black inside of the toner bottles 103Y, 103C, 103M, and 103K to developing devices 4Y, 4M, 4C, and 4K, which are disposed in the respective process units 2Y, 2M, 2C, and 2K. The toner bottles 103Y, 103M, 103C, and 103K are consumables that are changed when the toners inside of the bottles are run out. When the toners are run out, the toner bottles 103Y, 103M, 103C, and 103K are removably installed on the device main body to be changed.

Next, a description will be given of a toner replenishment unit as toner replenishment means.

Four toner replenishment units for Y, M, C, and K have mutually different colors of toner used in an image forming process, and otherwise similar to one another. Accordingly, in the following explanation, color references are omitted.

Figure 2:
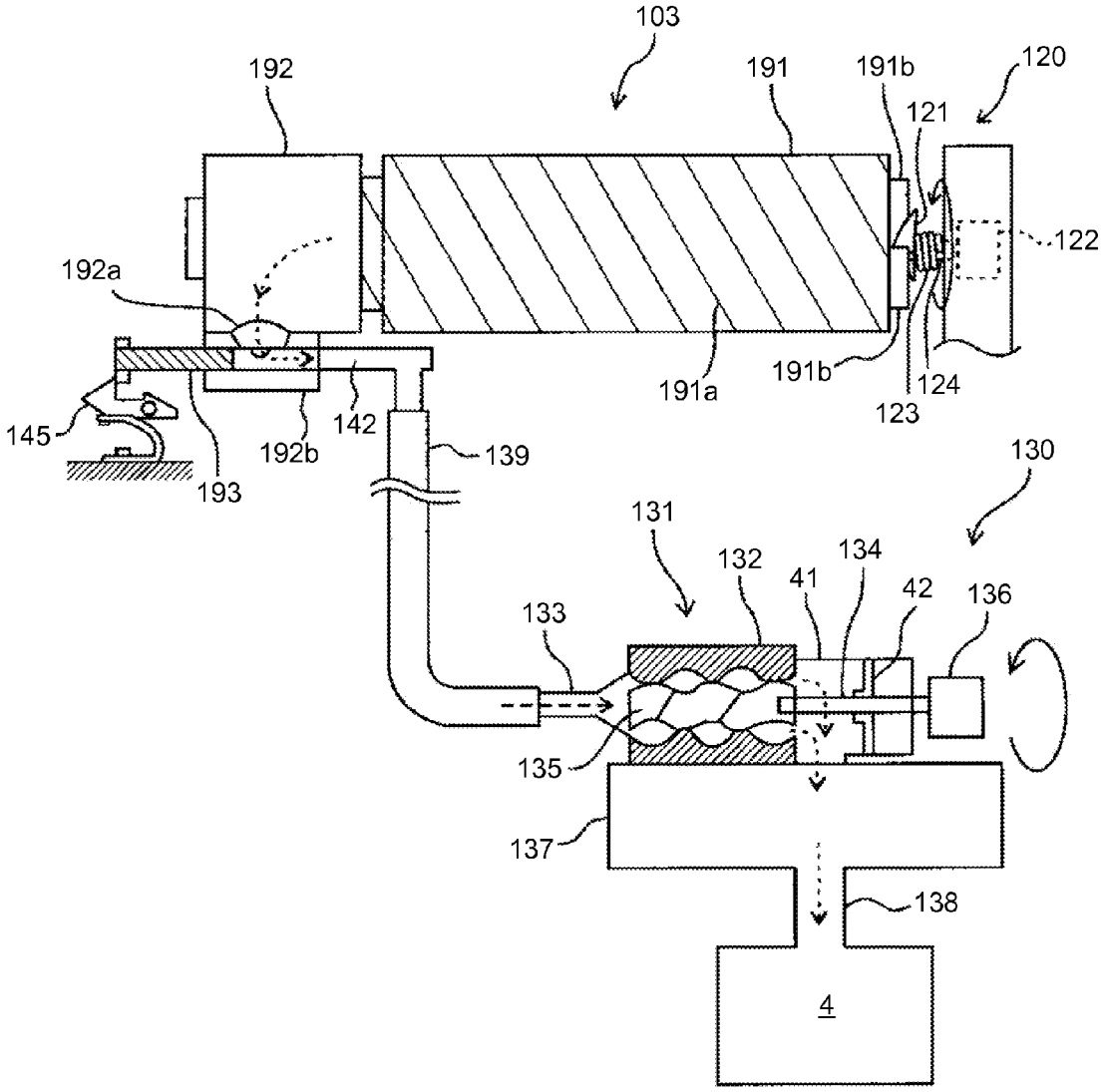
FIG. 2 is a schematic diagram illustrating a toner replenishment unit.

FIG. 2 is a schematic diagram illustrating a toner replenishment unit 130. The toner bottle 103 as a toner container includes a bottle portion 191, which houses the toner, a cap portion 192, which engages the head of the bottle portion 191 to rotatably hold the bottle portion 191. When the toner bottle 103 is mounted on the device main body, a nozzle 142 is inserted into a hole portion 192*b* of the cap portion 192 in conjunction with this mounting operation. At this time, a mouth plug member 193 as an opening and closing member of the toner bottle 103 opens a toner discharging port 192*a* (a powder discharge port) in a state where the mouth plug member 193 is sandwiched between the nozzle 142 and a claw member 145. Accordingly, the toner discharging port 192*a* communicates with a toner receiving port (a powder receiving port) that is disposed on the nozzle 142. The toner housed in the bottle portion 191 of the toner bottle 103 is conveyed into the nozzle 142 via the toner discharging port 192*a*.

On the other hand, the other end of the nozzle 142 is coupled to one end of a tube 139 as a toner replenishment path. The tube 139 is made of a flexible material, and has the other end coupled to a screw pump 131 that is a toner supply unit of the toner replenishment unit 130.

The material of the tube 139 may employ rubber material such as polyurethane, nitrile, EPDM, and silicon and resin material such as polyethylene and nylon. Use of this flexible tube 139 increases a degree of freedom in layout of the toner replenishment path, thus downsizing the image forming apparatus.

The screw pump 131 employs a suction type uniaxial eccentric screw pump that includes a rotor 135, a stator 132, a suction port 133, a universal joint 134, a gear 136, and similar member.

The stator 132, the universal joint 134, the rotor 135, and similar member are housed in a casing (not shown) made of resin. The stator 132 is a female screw-shaped member made of elastic material such as rubber, and includes double pitch spiral grooves inside. The rotor 135 is a male screw-shaped member that is made of rigid material such as metal, and formed to be twisted in a spiral shape. The rotor 135 is turnably fitted and inserted into the stator 132. The rotor 135 has one end coupled to the gear 136 via the universal joint 134, which is rotatably supported by a shaft bearing 42. The shaft bearing 42 is disposed in a cover 41 via a sealing member, and prevents the toner from leaking out between the shaft bearing 42 and the cover 41 by the sealing member.

In the screw pump 131, a rotational driving force from a driving motor (not shown) transmits to the gear 136. The gear 136 rotatably drives the rotor 135 inside of the stator 132 in a predetermined direction to generate a suctioning force to the suction port 133 (to generate a negative pressure inside the tube 139 by delivering air inside the tube 139). Accordingly, the toner inside of the toner bottle 103 is suctioned to the suction port 133 via the tube 139 along with air. The toner suctioned to the suction port 133 is sent in a gap between the stator 132 and the rotor 135, delivered to the other end side along with the rotation of the rotor 135, and then stored in a sub-hopper 137 that temporarily stores the toner. Subsequently, the toner temporarily stored in the sub-hopper 137 is conveyed through a toner conveying pipe 138 by a conveying screw (not shown) that is disposed in the toner conveying pipe 138, and then replenished in the developing device 4.

The bottle portion 191 of the toner bottle 103 is formed approximately in a cylindrical shape. The bottle portion 191 has an inner peripheral surface with a protrusion 191*a* in a spiral shape (which is a groove in a spiral shape when viewed from an outer peripheral surface side of the bottle portion 191).

A toner bottle driving unit 120 includes a drive coupling 121, a driving motor 122, a spring 123, a shaft 124, and similar member. The drive coupling 121 is disposed to engage a drive input unit 191*b* that is formed on a bottom portion of the bottle portion 191 of the toner bottle 103. The drive coupling 121 and the driving motor 122 are coupled via the shaft 124. A driving force of the driving motor 122 transmits to the drive coupling 121 via the shaft 124. Then, this driving force transmits to the bottle portion 191 via the drive input unit 191*b* of the toner bottle 103, which engages the drive coupling 121, so as to rotate the bottle portion 191 in an arrow direction in the drawing. With this rotation, the toner inside of the toner bottle 103 is sent out toward a space inside of the cap portion 192 by the protrusion 191*a* in the spiral shape disposed in the bottle portion 191.

In this embodiment, the toner container is a bottle type. A drive input received from the bottle driving unit in the back of the main body makes a rotating portion of the toner bottle 103 to rotate. Toner is conveyed to a fixed portion side, and then conveyed to the sub-hopper 137 from the fixed portion side by the screw pump 131. The conveying screw (not shown) inside of the sub-hopper 137 makes the toner to pass through the toner conveying pipe 138 from the sub-hopper 137 so as to be replenished to the developing device 4.

During exchange of the toner bottle 103, the operation of the screw pump 131 is stopped so as to stop replenishment of the toner to the sub-hopper 137 from the toner bottle 103. On the other hand, the operation of the replenishment of the toner to the developing device 4 from the sub-hopper 137 continues while the toner remains in the sub-hopper 137. In the case where the toner inside of the sub-hopper 137 runs low, the operation of the replenishment of the toner to the developing device 4 from the sub-hopper 137 stops. Additionally, in order to prevent a trouble on the main body of the image forming apparatus, the operation of image forming stops. In the event that the user completes exchange of the toner bottle 103, the operation of image forming restarts, and the operation of the replenishment of the toner then restarts.

This printer employs a toner with the peak temperature of loss elastic modulus of K-color toner that is lower than the peak temperatures of loss elastic modulus of the toners with the other colors (C, M, and Y). The peak temperature of loss elastic modulus correlates with ease of softening and melting of the toner. In the case where the peak temperature of loss elastic modulus is low, a temperature where the toner is softened and a temperature where the toner is melted become low. The loss elastic modulus indicates a thermal property of the toner more accurately than a glass-transition temperature (Tg), a softening temperature (Tm), an outflow start temperature (Ti) in the toner that is formed by blending a plurality of resins.

Here, a description will be given of the reason why only the K-color toner employs the toner with a low peak temperature of loss elastic modulus compared with the other colors.

The full-color image forming apparatus is preferred to have all four-color toners of K, C, M, and Y with similar thermal properties, specifically, thermal properties that allow the toners to be fixed at the same fixing temperature. However, as described above, it is difficult to develop a low-temperature fixing material corresponding to toners for all colors. In view of this, means for developing a low-temperature fixing material preferentially for a toner with a specific color (K color) is taken. The full-color image forming apparatus has both image forming modes for full color image forming, which uses the four-color toners of K, C, M, and Y, and monochrome image forming corresponding to an image of K only that is generally used for paperwork and similar work. In an image forming apparatus with this configuration, the full color image forming is controlled at a fixing temperature based on thermal properties of the toners of C, M, and Y while the monochrome image forming is simply controlled at a fixing temperature based on thermal property of K toner. Regarding the K toner, the low-temperature fixing material is preferentially developed. The K-color toner is fixed at a low temperature compared with the other colors (C, M, and Y colors). This saves energy when the monochrome image forming mode is performed.

Accordingly, the printer in this embodiment employs the toners where the K toner is fixed at low temperature compared with the other Y, M, and C toners. This ensures a lower fixing temperature of the monochrome image forming mode than that of the full-color image forming mode. This also ensures shorter turn-on time of electric power to be supplied to the fixing device 40 or a heater than that of the full-color image forming mode. This saves energy of the apparatus compared with an apparatus where the thermal property (the peak temperature of loss elastic modulus) of the K-color toner is the same as the thermal properties (the peak temperatures of loss elastic modulus) of the toners with the other colors (C, M, and Y).

When the full color image forming is performed, in the case where the above-described K-color toner with a low peak temperature of loss elastic modulus is used, a satisfactory fixing characteristic might not be obtained due to occurrence of peeling phenomenon between toners, uneven development, uneven brightness, and similar trouble. Accordingly, when the full color image forming is performed, black may be formed using C, M, and Y toners so as not to use K-color toner.

However, the toner with a low peak temperature of loss elastic modulus easily causes blocking where the toner condenses into a lump.

Figure 3:
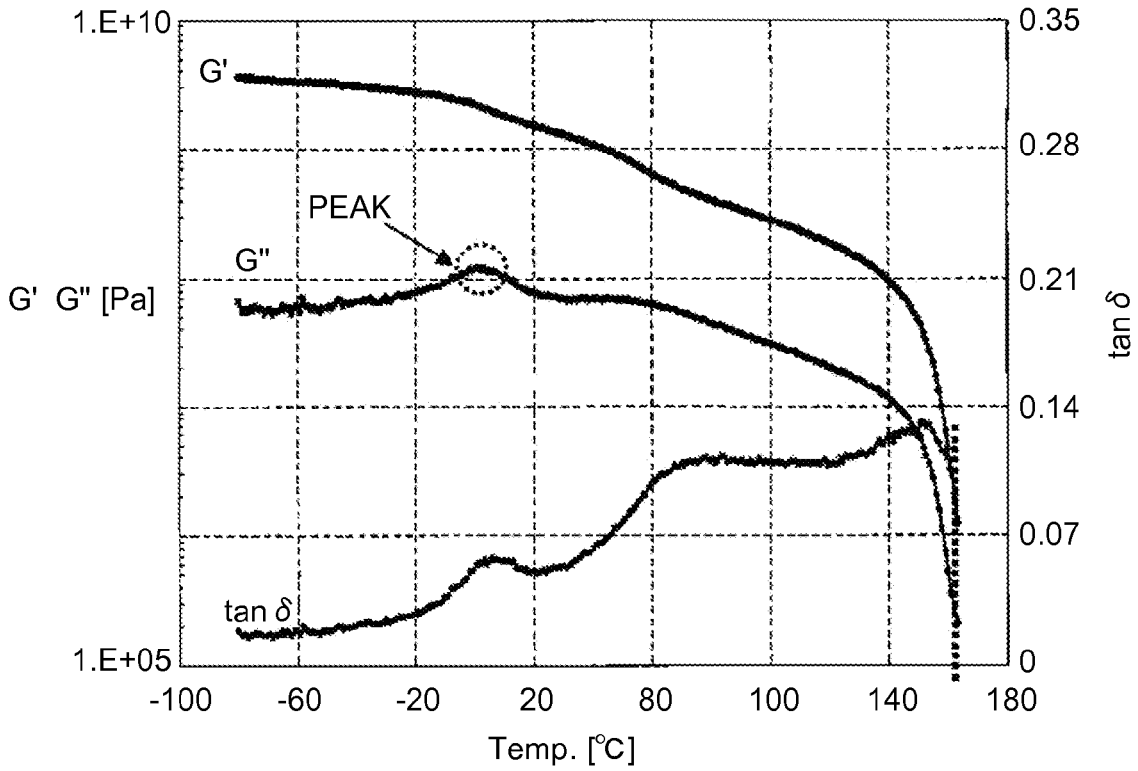
FIG. 3 is a graph illustrating a result of a viscoelastic characteristics of a K-color toner measured by a dynamic viscoelasticity measuring device.

FIG. 3 illustrates a result of a viscoelastic characteristics of a K-color toner measured by the dynamic viscoelasticity measuring device according to this embodiment. G' in the drawing indicates storage elastic modulus (Pa), and corresponds to an elasticity component of the toner. G" in the drawing indicates loss elastic modulus (Pa), and corresponds to a viscosity component of the toner. Tan δ in the drawing is equal to the storage elastic modulus G' divided by the loss elastic modulus G". The toner has a characteristic where a lower peak temperature of loss elastic modulus G" causes a lower viscosity at a lower temperature. Accordingly, the toner is softened and melted at a lower temperature. This provides a low temperature fixing characteristic. The toner also has the characteristic where a lower peak temperature of loss elastic modulus G" causes a lower viscosity at a lower temperature. This provides a toner that easily causes blocking in the apparatus.

Generally, microparticles of, for example, silica, titania, and alumina is externally added to the toner to be attached on a toner surface. These microparticles have one function that reduces direct contact of the toner surface (the resin) with a member to prevent blocking as an advantageous effect. However, softening of the toner due to heat causes a phenomenon that makes these microparticles buried from the toner surface to inside. In the toner in this state, its surface (the resin) is easily brought in direct contact with the members, thus easily causing blocking. This operation causes blocking. Accordingly, the loss elastic modulus (G") indicative of a viscosity characteristic of the toner functions as an index value indicative of thermal property of the toner. Also, the loss elastic modulus (G") is an appropriate index value as an index value indicative of ease of blocking.

Figure 4:
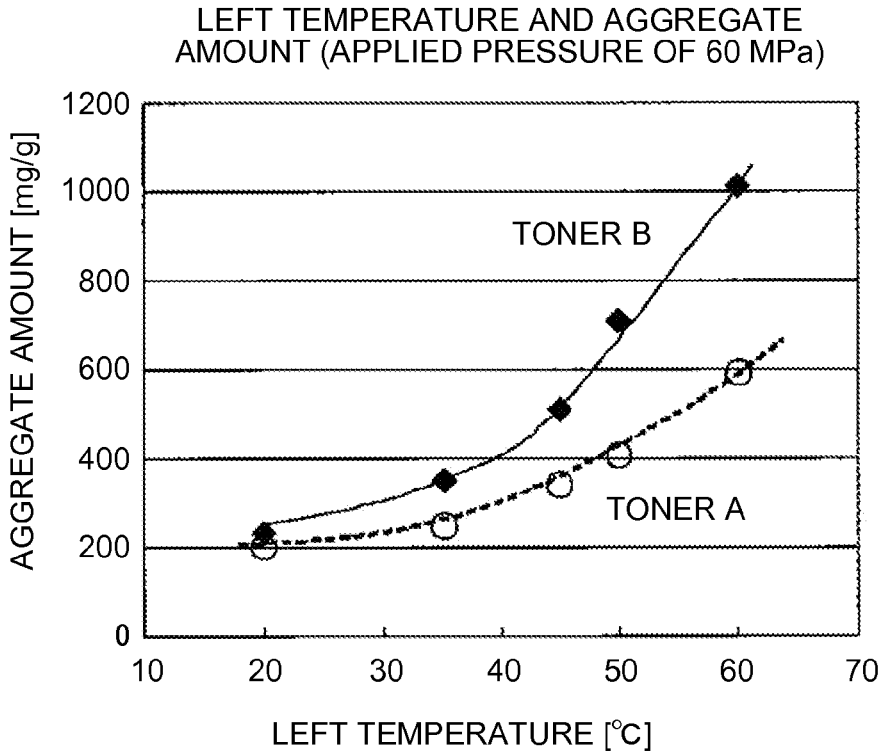
FIG. 4 is a graph illustrating aggregate amounts per gram that are left after a certain period of time in a state where toners are pressed.

FIG. 4 is a graph illustrating aggregate amounts per gram that are left after a certain period of time in a state where toners are pressed. The aggregate amount is measurements of weight of an extracted lump of toner remaining on a screen after the toner is screened. The aggregate amount may be used as a value that quantitatively indicates blocking. Toner B in the drawing is toner with a lower peak temperature of loss elastic modulus than that of toner A. The toner B allows setting a fixing temperature to a temperature about 15° C. lower than that of the toner A.

As illustrated in FIG. 4, the toner B with a low peak temperature of loss elastic modulus easily causes blocking by temperature compared with the toner A.

When the apparatus operates, a heat source from the fixing device 40 increases temperature inside of the apparatus in addition to heat generation of the electric power supply, the driving motor, and similar member. Therefore, means for preventing temperature increase inside of the machine is disposed in cooling design where airflow is taken from outside of the apparatus to inside of the apparatus and discharged from inside of the apparatus to outside of the apparatus. However, uniformly cooling temperature inside of the apparatus becomes difficult based on a narrow airflow path due to downsizing of the apparatus and a reduced number of fans due to sound noise reduction.

Figure 5:
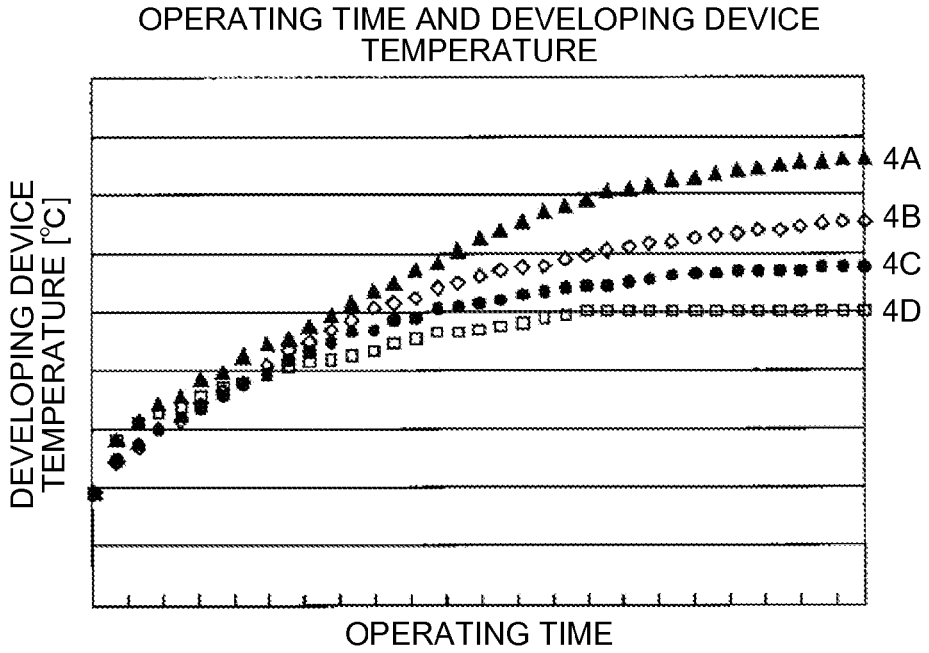
FIG. 5 is a graph illustrating temperature transitions of respective developing devices with respect to operating time of an image forming apparatus in FIG. 6.
Figure 6:
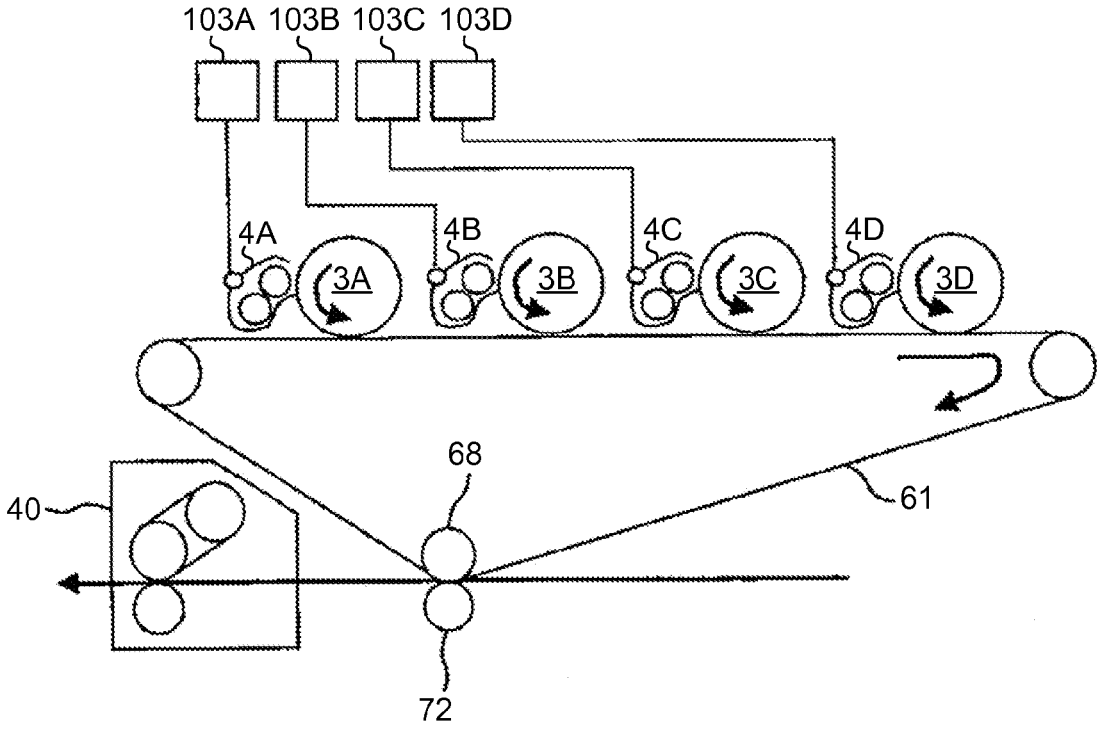
FIG. 6 is a schematic configuration diagram of an image forming apparatus that is used for examining a temperature transition.

FIG. 5 is a graph illustrating temperature transitions of respective developing devices 4A, 4B, 4C, and 4D with respect to operating time of an image forming apparatus in FIG. 6. As illustrated in the drawing, the respective developing devices 4A to 4D increase in temperature when operating and consequently reach different temperatures. The above-described heat source, especially, the heat from the fixing device 40 significantly affects the temperatures during the operation. The fixing device 40 has a large absolute value of heat amount to be generated. Air around the fixing device 40 heated by the heat source moves to the upper side of the apparatus by its updraft. Subsequently, the air hits the developing device 4 disposed on the upper side of the fixing device 40, thus heating the developing device. The heat also transmits through a metal portion and similar portion and heats the developing device. Accordingly, the temperature increase of the developing device is found to be determined by a distance from the fixing device 40. That is, a developing device disposed in a farthest position from the fixing device 40 allows the most suppressed temperature increase.

Figure 7:
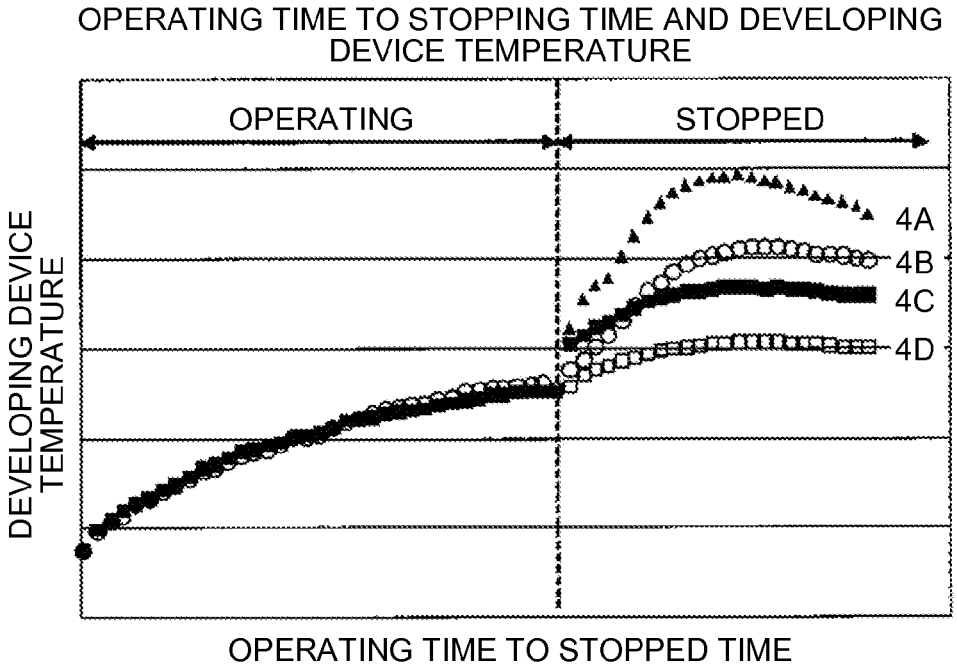
FIG. 7 is a graph illustrating temperature transitions of the respective developing devices in the case where temperatures of the respective developing devices become approximately uniform by airflow control of a fan when the image forming apparatus in FIG. 6 operates.

FIG. 7 is a graph illustrating temperature transitions of the respective developing devices 4A to 4D in the case where temperatures of the respective developing devices 4A to 4D become approximately uniform by airflow control of a fan in the image forming apparatus of FIG. 6.

As illustrated in FIG. 7, when the apparatus operates with airflow control of the fan, temperatures of the respective developing devices are approximately uniform. However, when the apparatus is stopped and rotation of the fan stops, the respective developing devices temporarily increase in temperature more than during the operation. After the apparatus stops, heat accumulated by heat capacity of the fixing device 40 is discharged. This heat heats the developing devices. At this time, the rotation of the fan is stopped. The developing devices are not cooled. Thus, after the apparatus is stopped, the temperatures of the respective developing devices 4A to 4D are temporarily increased more than during the operation. Then, the temperature increase of the developing devices due to heat release of the fixing device 40 after the operation is stopped is determined by a distance from the fixing device 40 similarly to during the operation. That is, in this case, a developing device disposed in a farthest position from the fixing device 40 allows the most suppressed temperature increase.

Accordingly, as illustrated in FIG. 1, the K-color developing device 4K as a housing unit that houses the toner with the lowest peak temperature of loss elastic modulus is disposed in a portion where temperature increase is suppressed compared with the other developing devices, that is, in a position apart from the fixing device compared with the other developing devices. This prevents blocking of the toner inside of the K-color developing device 4K.

Figure 8:
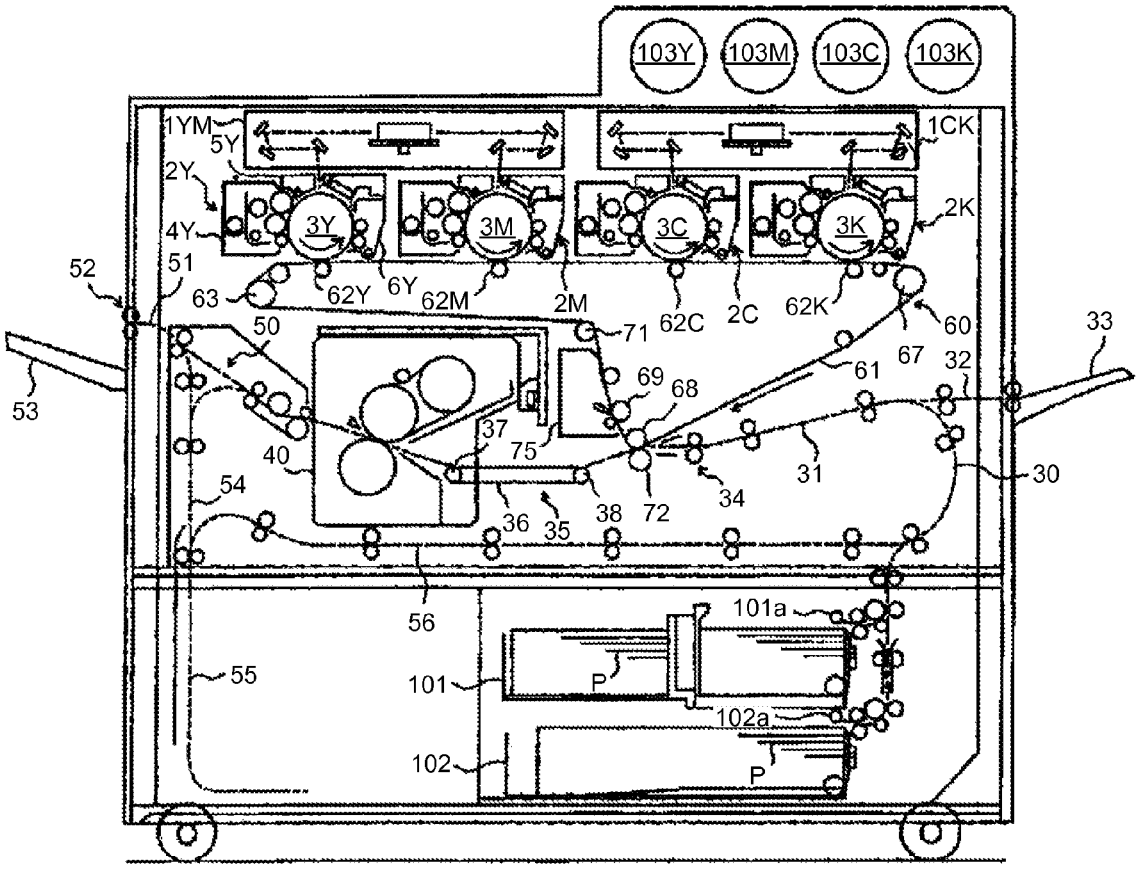
FIG. 8 is a diagram illustrating a modification of this embodiment.

FIG. 8 is a diagram illustrating a modification of this embodiment.

In the printer of FIG. 1, the toner bottle 103K as the housing unit that houses the K-color toner with the lowest peak temperature of loss elastic modulus is disposed on the upper side of the fixing device 40. The air heated by the heat source of the fixing device 40 flows into the space where the toner bottles 103Y to 103K are disposed by its updraft. This may heat the toner bottles 103Y, 103M, 103C, and 103K. When the K-color toner bottle 103K is heated, the toner with the lowest peak temperature of loss elastic modulus, which is housed in the K-color toner bottle 103K, may condense and cause blocking. The tube 139 couples the toner bottle 103K and the developing device 4K so as to convey the toner inside of the toner bottle 103K to the developing device 4K. The tube 139 (see FIG. 2) runs around a portion at high temperature. Accordingly, the K-color toner with a low peak temperature of loss elastic modulus inside of the tube 139 condenses and may block the tube 139.

Therefore, as illustrated in FIG. 8, the K-color toner bottle 103K may be disposed on the upper side of the optical writing unit 1CK, which is on the upper right edge of the drawing, so as to be in a position apart from the fixing device 40 compared with the other toner bottles 103Y to 103C. The K-color toner bottle 103K is disposed apart from the fixing device 40 compared with the other toner bottles 103Y to 103C. This allows suppressing temperature increase of the K-color toner bottle 103K compared with the other toner bottles 103Y to 103C. This prevents the toner with the lowest peak temperature of loss elastic modulus housed in the K-color toner bottle 103K from condensing inside of the toner bottle 103K. The K-color developing device 4K is in the position apart from the fixing device 40. This allows the tube 139, which conveys the toner inside of the K-color toner bottle to the developing device 4K, to run around a portion at low temperature inside of the apparatus, thus preventing temperature increase of the tube 139. This prevents the toner with a low peak temperature of loss elastic modulus inside of the tube 139 from condensing, thus preventing blocking of the tube 139.

Figure 9:
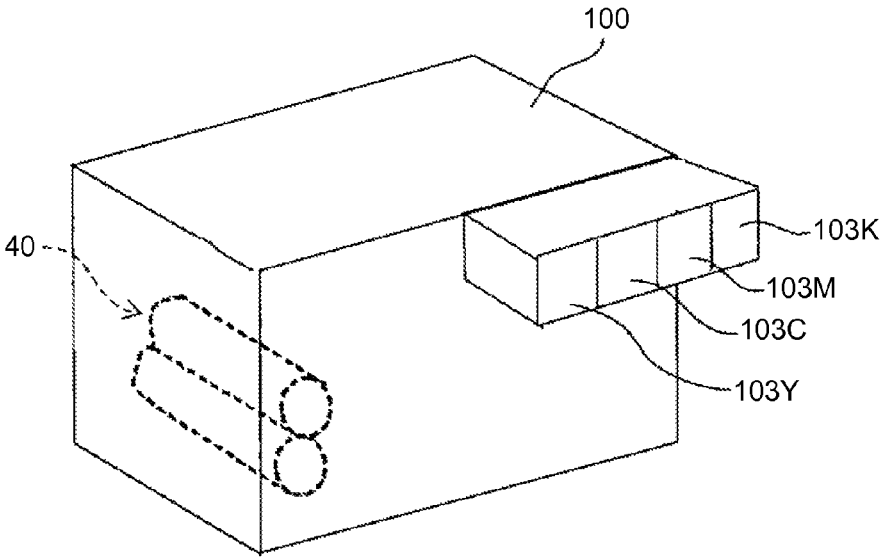
FIG. 9 is a schematic configuration diagram where respective toner bottles are disposed on a side surface of a device main body.
Figure 10:
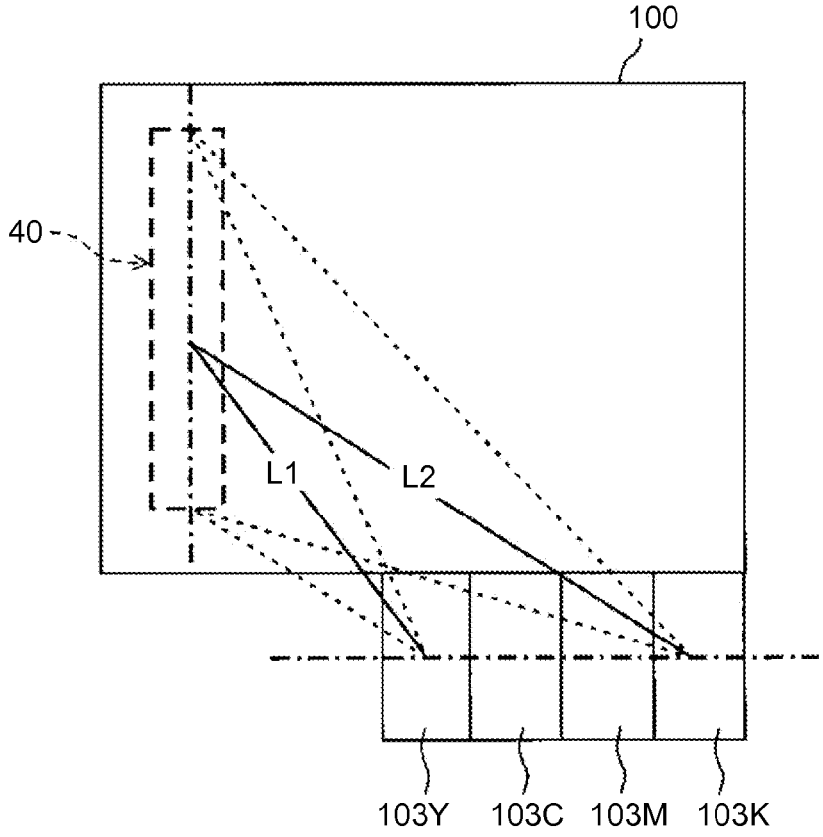
FIG. 10 is an explanatory diagram illustrating a distance between a fixing device and toner bottles in the configuration of FIG. 9.

While in FIG. 8, the toner bottles 103Y to 103K as the housing unit are disposed on the top surface of the device main body, which includes the fixing device 40 and similar member, the toner bottles 103Y to 103K may be disposed on a side surface of a device main body 100 as illustrated in FIG. 9. In this case, the K-color toner bottle 103K, which houses the toner with the lowest peak temperature of loss elastic modulus, is disposed in a position apart from the fixing device 40 compared with the other toner bottles 103Y to 103M. Specifically, as illustrated in FIG. 10, a distance L2 is defined as a distance from the center of the fixing device 40 in the longitudinal direction to the center of the K-color toner bottle 103K in the longitudinal direction. The K-color toner bottle 103K is disposed such that the distance L2 is longer than distances from the center of the fixing device 40 in the longitudinal direction to the center of the other toner bottles in the longitudinal direction.

Figure 11:
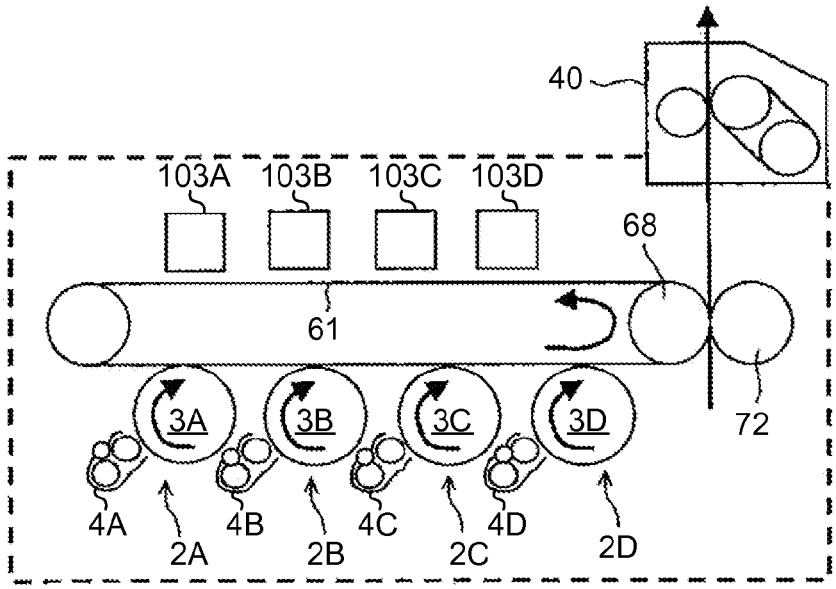
FIG. 11 is a schematic configuration diagram illustrating an image forming apparatus with a layout different from that of the image forming apparatus in FIG. 1.

FIG. 11 is a schematic configuration diagram illustrating an image forming apparatus with a layout different from that of the image forming apparatus in FIG. 1.

This image forming apparatus has a layout as follows. Process units are disposed below the intermediate transfer belt 61. Toner bottles 103A to 103D and the fixing device 40 are disposed above the upper side of the intermediate transfer belt 61. This image forming apparatus has a different layout from that of the image forming apparatus in FIG. 1 as follows. The toner bottles 103A to 103D as the housing units are in positions closer to the fixing device 40 than the developing devices 4A to 4D as the housing units. In view of this, in the image forming apparatus with the configuration in FIG. 11, the toner bottles 103A to 103D are easily affected by heat of the fixing device 40 compared with the developing devices 4A to 4D.

The blocking by the above-described condensed toner easily occurs when the toners exist for a longer time in a state where the toners slightly move, including staying still. Considering this, blocking easily occurs in the toner bottle that operates only when supplying replenishment toner to the developing device compared with the developing device that constantly operates to fluidize the toner when forming an image. Therefore, the toner bottle 103A farthest from the fixing device 40 is preferred to be the K-color toner bottle.

In order to make first copy time (which is a time from pressing of a print button until discharging of a first output image) fastest in the black and white image forming mode where an image is formed with K-color only, which is frequently used, the following configuration is preferred. The process unit 2K is disposed in a position closest to the secondary transfer compared with the other process units 2Y to 2C in a surface moving direction of the intermediate transfer belt 61. Accordingly, the longer a running distance of the intermediate transfer belt 61 until the image processed by the primary transfer is processed by the secondary transfer becomes, the farther the process unit from the secondary transfer becomes, that is, the primary transfer position of the process unit from the secondary transfer position becomes. As a result, as the K-color process unit is disposed in a position farther from the secondary transfer, the first copy time in the monochrome image forming mode becomes slow.

In the configuration of FIG. 11, a process unit 2D is assigned to the K-color process unit. This makes the first copy time in the black and white image forming mode faster compared with a case where the K-color process unit is assigned to the process units 2A, 2B, and 2C. However, as illustrated in FIG. 11, the process unit 2D is closer to the fixing device 40 than the other process units 2A, 2B, and 2C.

In contrast, in the image forming apparatus illustrated in the layout of FIG. 11, the developing device 4D, which is disposed in a position closest to the fixing device 40, is in a position apart from the fixing device 40 at a certain distance. As described above, the developing device constantly operates to fluidize the toner when forming an image. Thus, blocking does not easily occur. Accordingly, even if the K-color process unit is disposed in a position of the process unit 2D in FIG. 11, toner blocking does not easily occur.

Figure 12:
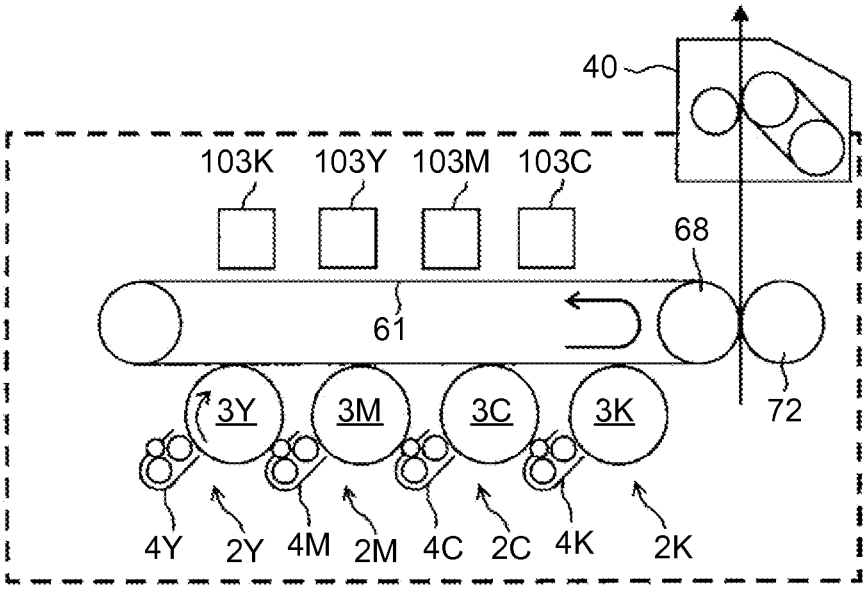
FIG. 12 is a diagram illustrating exemplary locations of toner bottles of respective colors and process units of respective colors in the image forming apparatus of FIG. 11.

In view of the above-described circumstances, the K-color toner bottle 103K and the process unit 2K (the developing device 4K) are disposed as illustrated in FIG. 12. That is, the toner bottle 103K as the housing unit is disposed in a position apart from the fixing device 40 compared with the other toner bottles 103Y to 103K. The K-color process unit 2K (the developing device 4K) is disposed in a position (a position closer to the secondary transfer position) closer to the fixing device 40 than the other process units 2Y to 2C (the other developing devices 4Y to 4C). That is, FIG. 12 illustrates an embodiment where only the K-color toner bottle 103K as the housing unit is separated from the fixing device 40 compared with the other toner bottles 103Y to 103C.

This configuration makes the first copy time in the black and white image forming mode faster while preventing toner blocking inside of the toner bottle 103K as the housing unit. The configuration in FIG. 12 is preferred to be configured as follows. The developing device 4K is actively cooled by, for example, airflow inside the machine. The portion where the developing device 4K is disposed has a lower temperature than those of portions where the other developing devices 4Y to 4C are disposed. This properly prevents toner blocking inside of the K-color developing device 4K.

In the configuration of FIG. 12, the developing device 4K is in a position apart from the fixing device 40 at a certain distance. Accordingly, the developing device 4K can suppress temperature increase of the developing device after the fan stops compared with the developing device 4A in FIG. 6. The portion where the developing device 4K is disposed has a lower temperature than those of portions where the other developing devices 4Y to 4C are disposed thanks to a fan and similar member during the operation. This keeps lower temperature than in portions where the other developing devices are disposed even after the apparatus stops, and the fan or similar unit stops. Accordingly, this prevents blocking from occurring inside of the K-color developing device.

Figure 13:
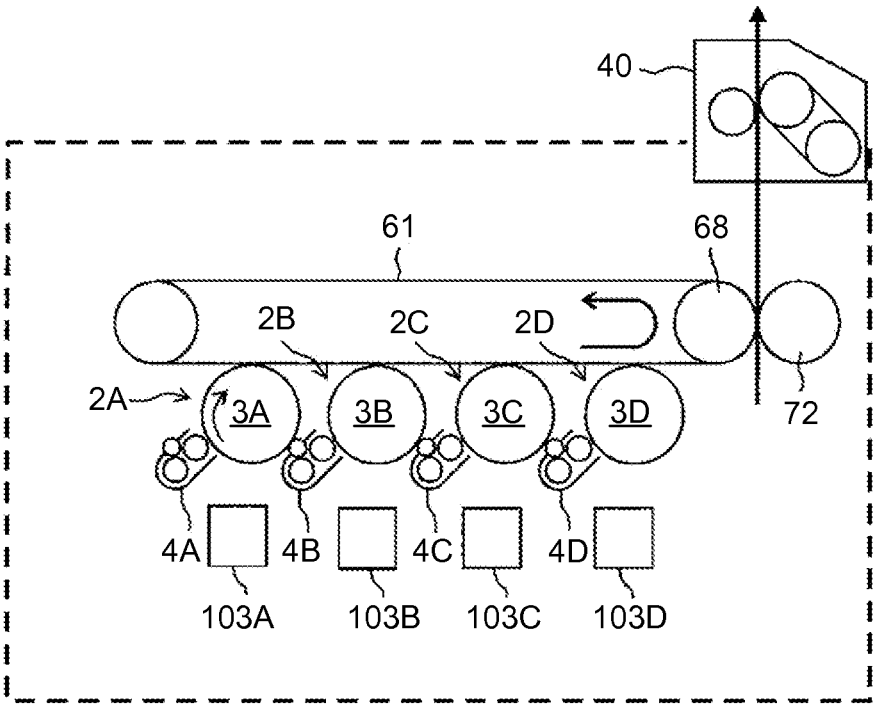
FIG. 13 is a schematic configuration diagram of the image forming apparatus illustrating a modification of the layout in FIG. 11.

As illustrated in FIG. 13, in the case where the respective toner bottles 103A to 103D are disposed below the process units 2A to 2D, the developing device 4D and the toner bottle 103D are actively cooled by, for example, a fan, thus being a portion with a lower temperature than those of the other developing devices 4A to 4C and the other toner bottles 103A to 103C. This makes the positions of the developing device 4D and the toner bottle 103D, which are closest to the fixing device 40, to have lower temperatures than those of the other positions.

That is, in the configuration of FIG. 13, the developing device 4D and the toner bottle 103D, which are disposed in a position closest to the fixing device 40, are in positions apart from the fixing device 40 at a certain distance. The fixing device 40 itself is disposed at the upper portion of the apparatus, and is not housed in the apparatus (a dashed line in the drawing indicates a range of the apparatus). Therefore, this suppresses temperature increase of the developing device and the toner bottle that are disposed in positions closest to the fixing device by influence of heat capacity of the fixing device 40 after the fan is stopped, compared with the configuration in FIG. 6, and compared with the developing devices 4A and 4B. This allows easily making the temperature lower than those of the other portions using, for example, the fan.

Accordingly, actively cooling the developing device 4D and the toner bottle 103D with a fan during the operation of the apparatus provides a portion with a lower temperature than those of the other portions. This also keeps lower temperature than those in the other portions after the apparatus stops. That is, in the layout of FIG. 13, this makes the positions of the developing device 4D and the toner bottle 103D, which are closest to the fixing device 40, to have lower temperatures than those of the other positions.

This allows the following configuration. The process unit 2D, which is closest to the fixing device compared with the other process units, is assigned to the K-color process unit 2K. The developing device 4D, which is in a position closer to the fixing device 40 compared with the other developing devices, is assigned to the K-color developing device that houses the K-color toner with the lowest peak temperature of loss elastic modulus. Additionally, the toner bottle 103D, which is closest to the fixing device, is assigned to the K-color toner bottle that houses the K toner with the lowest peak temperature of loss elastic modulus.

This prevents toner blocking inside of the developing device 4K, and also makes the first copy time in the black and white image forming mode faster. This also prevents blocking inside of the toner bottle 103K. Additionally, this allows the K-color toner bottle 103K to be disposed adjacent to the K-color developing device 4K. Therefore, this minimizes the running of the tube 139 (see FIG. 2), thus ensuring the simplified apparatus.

The K-color toner in this embodiment is toner mother particles with the addition of additive. The toner mother particles include colorant and resin including at least crystalline polyester. Inclusion of crystalline polyester provides a low temperature fixing characteristic (a low peak temperature of loss elastic modulus) and ensures a toner with high sharp melting property.

Additionally, the K-color toner may employ toner mother particles including a resin that has phase transition under pressure and colorant, with the addition of additive. This toner including resin that has phase transition under pressure and colorant has a low peak temperature of loss elastic modulus, thus easily causing toner blocking. Accordingly, the K-color developing device is preferred to be disposed in a position with a lower temperature than those in positions of the developing devices with Y, M, and C colors.

The resin that has phase transition under pressure, which constitutes the toner, is preferred to be resin with a microphase-separated structure, and more preferably with a block copolymer structure or a core-shell structure. Additionally, this block copolymer is constituted of hard segment polymer with a high glass-transition temperature Tg, and soft segment polymer with a low glass-transition temperature Tg or a low melting point. The above-described resin with the core-shell structure is further preferred to include a core and a shell as follows. One of the core and the shell is constituted of hard segment polymer (hereinafter referred to as "hard segment component phase" as necessary) with a high glass-transition temperature Tg. The other is constituted of soft segment polymer (hereinafter referred to as "soft segment component phase" as necessary) with a low glass-transition temperature Tg or a low melting point.

In the case where the above-described resin that has phase transition under pressure is used for the K-color toner, fluidity of resin appears under pressure stimulation. In an image forming process with a predetermined fixing process, this allows obtaining desired fluidity of resin that is required for the fixing process.

The above-described resin that has phase transition under pressure may employ, for example, resin polymerized by a polycondensation mechanism, or resin where unsaturated ethylene monomer is polymerized by a radical polymerization mechanism.

The above-described resin polymerized by the polycondensation mechanism can be synthesized by a conventional known method described in, for example, "polycondensation" (Kagaku-Dojin Publishing Company, INC, publication in 1971) or "Polyester Resin Hand Book" (edited by Nikkan Kogyo Shimbun Ltd., publication in 1988). The above-described resin polymerized by the polycondensation mechanism can be synthesized by a transesterification method or a direct polycondensation method alone, or by a combination of these methods. The above-described resin polymerized by the polycondensation mechanism is preferred to be polyester resin.

The above-described resin where the unsaturated ethylene monomer is polymerized may employ, for example, a block copolymer obtained by a living anionic polymerization method. In the case of a core-shell particle, a method called a two-stage feeding method is used. This method supplies a monomer into a polymerization system in stages. This allows synthesizing nanosized core-shell resin particles that are constituted of core component polymer and shell component polymer, and have different glass-transition temperatures, which is preferred.

The above-described hard segment component phase is preferred to have a glass-transition temperature Tg from 45 to 120° C., more preferably, in a range of 50 to 110° C. The above-described soft segment component phase is preferred to have a glass-transition temperature Tg that is lower than a glass-transition temperature Tg of the above-described hard segment component phase by equal to or more than 20° C., more preferably, by equal to or more than 30° C. in order to efficiently make fluidity of resin under pressure stimulation to appear. Here, a value of the above-described glass-transition temperature Tg means a value measured with a method specified by ASTM D3418-82 when a measurement is performed with a differential scanning calorimetry (DSC) from −80 to 140° C. at a temperature increase rate of 10° C. per minute.

Regarding the above-described block copolymer or polyester resin polycondensed, existing dispersion methods are used to produce a resin particle dispersion liquid similarly to nanosized core-shell particles. For example, a shear emulsification method disperses the block copolymer or the polyester resin in an aqueous medium by various mechanical high shear forces such as a rotary shearing type homogenizer, a ball mill using media, a sand mill using media, a dyno mill using media, a pressure discharge disperser (Gaulin Homogenizer, made by Gaulin Corporation), and similar device. A phase inversion emulsification method dissolves the resin in an organic solvent, and then adds an aqueous medium to invert the phase. Another method mixes the block copolymer or its precursor (living terminal low molecular weight compound or a block) with a small amount of an ethylenically unsaturated compound, and after shear emulsification or phase inversion emulsification, compounds the resin particle dispersion liquid of the block copolymer by miniemulsion polymerization or suspension polymerization. For example, the obtained resin dispersion liquid is combined with an appropriate amount of colorant-containing dispersion liquid and mold release agent-containing dispersion liquid as necessary. Then, a toner for image forming is manufactured by an emulsion aggregation method.

In the method for manufacturing the toner for image forming, a known aggregation method performs aggregation (association) of the above-described resin particle inside of the dispersion liquid, a mold release agent particle, and another added particle. Performing aggregation (association) with this method allows adjusting a toner particle diameter and a particle diameter distribution.

Specifically, a resin particle dispersion liquid and a releasing agent particle dispersion liquid are mixed with a colorant particle dispersion liquid and similar liquid. Additionally, an aggregating agent is added to cause hetero aggregation, thus forming aggregated particles having toner diameters. Subsequently, a system of the combination of the dispersion liquids is heated to a temperature equal to or more than a glass-transition temperature of the resin particle or equal to or more than a melting point, so as to make the aggregated particles fuse together. Then, cleaning and drying is performed to obtain the toner. At this time, selecting a heating temperature condition allows controlling the toner shape from an amorphous shape to a spherical shape.

The above-described polycondensation resin is preferred to be amorphous polyester resin and crystalline polyester resin. The polyester resin may be manufactured by polycondensation by, for example, direct esterification reaction and ester exchange reaction using a polycondensation monomer such as a polycarboxylic acid, a polyhydric alcohol, and a hydroxycarboxylic acid. In the polycondensation, a polycondensation catalyst is preferred to be used in combination to accelerate the polycondensation. The polycarboxylic acid includes aliphatic, alicyclic, and aromatic polycarboxylic acids, and an alkyl ester, an acid anhydride, and an acid halide of these acids. The polyhydric alcohol includes a polyhydric alcohol and an ester compound of the polyhydric alcohols.

The alkyl ester of the polycarboxylic acid is preferred to be a lower alkyl ester. Here, "the lower alkyl ester" is an alkyl ester where the number of carbon atom in the alkoxy portion of the ester is 1 to 8. Specifically, the lower alkyl ester includes methyl ester, ethyl ester, n-propyl ester, isopropyl ester, n-butyl ester, isobutyl ester, and similar ester.

The polycarboxylic acid is a compound that includes equal to or more than two carboxy groups in one molecule. Among these polycarboxylic acids, a dicarboxylic acid is a compound that includes two carboxy groups in one molecule. For example, the dicarboxylic acid includes oxalic acid, succinic acid, maleic acid, adipic acid, β-methyl adipic acid, azelaic acid, sebacic acid, nonanedicarboxylic acid, decanedicarboxylic acid, undecanedicarboxylic acid, dodecenylsuccinic acid, dodecanedicarboxylic acid, fumaric acid, citraconic acid, diglycolic acid, cyclohexanedicarboxylic acid, cyclohexane-3,5-diene-1,2-dicarboxylic acid, 2,2-dimethylol butanoic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl acetic acid, p-phenylene diacetate, m-phenylene diglycolic acid, p-phenylene diglycolic acid, o-phenylene diglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid.

The polycarboxylic acid other than the dicarboxylic acid includes, for example, trimellitic acid, pyromellitic acid, naphthalenetricarboxylic acid, naphthalenetetracarboxylic acid, pyrene tricarboxylic acid, pyrene tetracarboxylic acid.

These polycarboxylic acids may be used such that one kind is used alone, or equal to or more than two kinds are used in combination.

The polyhydric alcohol (polyol) is a compound that includes equal to or more than two hydroxyl groups in one molecule. Among these polyhydric alcohols, a diol is a compound that includes two hydroxyl groups in one molecule. For example, the diol includes ethylene glycol, propylene glycol, butanediol, diethylene glycol, triethylene glycol, hexanediol, cyclohexanediol, octanediol, decanediol, dodecanediol, ethylene oxide adducts of bisphenol A, propylene oxide adducts of bisphenol A, bisphenoxy alcohol fluorene (bisphenoxy ethanol fluorene).

The polyol other than the diol includes, for example, glycerin, pentaerythritol, hexamethylolmelamine, hexaethylolmelamine, tetramethylolbenzoguanamine, tetraethylolbenzoguanamine. These polyhydric alcohols (polyols) may be used such that one kind is used alone, or equal to or more than two kinds are used in combination.

The ethylenically unsaturated compound is a compound that includes at least one ethylenically unsaturated bond, and may be a monomer having a hydrophilic group and ethylenically unsaturated bond. The ethylenically unsaturated compound includes, for example, styrenes such as styrene, parachlorostyrene, and α-methylstyrene; (meth)acrylic acid esters such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate, and 2-ethylhexyl methacrylate; ethylenically unsaturated nitriles such as acrylonitrile and methacrylonitrile; ethylenically unsaturated carboxylic acid such as acrylic acid, methacrylic acid, and crotonic acid; vinyl ethers such as vinyl methyl ether and vinyl isobutyl ether; vinyl ketones such as vinyl methyl ketone, vinyl ethyl ketone, and vinyl isopropenyl ketone; olefins such as isoprenoid, butene, and butadiene; and β-carboxyethyl acrylate, which are preferred examples. A homopolymer including these monomers, a copolymer obtained by copolymerizing two kinds of these monomers, or a mixture of these monomers may be used.

The hydrophilic group includes a polar group. For example, the polar group includes an acidic polar group such as a carboxy group, a sulfo group, and a phosphonyl group; a basic polar group such as an amino group; a neutral polar group such as an amido group, a hydroxy group, a cyano group, and a formyl group. This, however, should not be construed in a limiting sense. Among these hydrophilic groups, a group especially preferred to be used for the toner in this embodiment is the acidic polar group. Existence of a monomer having the acidic polar group and the ethylenically unsaturated bond on the surface of the resin particle in a specific range allows adding aggregating property to the resin particle. This allows the resin particle to make toner, and also allows adding sufficient charging property to the toner. A preferred acidic polar group includes the carboxy group and the sulfo group. The monomer having this acidic polar group includes, for example, an α,β-ethylenically unsaturated compound with a carboxy group and an α,β-ethylenically unsaturated compound with a sulfo group. The α,β-ethylenically unsaturated compound with a carboxy group includes, for example, acrylic acid, methacrylic acid, fumaric acid, maleic acid, itaconic acid, cinnamic acid, monomethyl maleate, maleic acid monobutyl ester, maleic acid mono octyl ester. These monomers may be used such that one kind is used alone, or equal to or more than two kinds are used in combination.

A resin with a glass-transition temperature Tg equal to or more than 40° C. is preferred to be a random copolymer in the case where the resin is a polymer of the ethylenically unsaturated compound. Also, the resin is preferred to contain a monomer unit of an ethylenically unsaturated compound with a hydrophilic group. The resin is preferred to contain the ethylenically unsaturated compound with a hydrophilic group in copolymerization ratio of 0.1 to 10 mol %. In the case where the copolymerization ratio is within this range, in a manufacturing process of a toner in an aqueous medium, a resin with Tg equal to or more than 40° C. easily forms a shell layer of the toner, which is preferred. A polymer of the ethylenically unsaturated compound with Tg equal to or more than 40° C. and a polycondensation resin such as a polyester resin are preferred to be equal to or less than 50 wt % of all binder resins in the toner, more preferably, 5 to 20 wt % of all the binder resins. The copolymerization ratio within the above-described range improves toner durability, and provides stable image quality characteristics.

A colorant used for the K-color toner includes, for example, carbon black, copper oxide, manganese dioxide, aniline black, activated charcoal, non-magnetic ferrite, and magnetite. These colorants are used alone or mixed to be used.

These colorants employ any method to prepare dispersion liquid of colorant particles. A general dispersion method employs, for example, a rotary shearing type homogenizer and a medium type disperser such as a ball mill, a sand mill, and an attritor that each have a medium; a high-pressure counter collision disperser; and a dyno mill. These colorants are dispersed in the aqueous medium by a homogenizer using a surfactant with polarity. The colorants may be added in mixed solvent with another particle component at once, or may be divided and added in a multistage.

The colorant may be selected from the aspects of hue angle, chroma, lightness, weather resistance, OHP transparency, dispersibility in the toner. The colorant is added in a range from 4 to 15 wt % of whole weight of solid composing the toner. In the case where a black colorant employs magnetic material, the colorant is added from 12 to 240 wt % unlike another colorant. The above-described adding quantity of the colorant is preferred quantity to ensure chromogenic property when the toner is fixed. Making the center diameter (median diameter) of the colorant particle inside of the toner to be from 100 to 330 nm ensures OHP transparency and chromogenic property. The center diameter of the colorant particle is measured by, for example, a laser diffraction particle size analyzer (LA-920, manufactured by Horiba, Ltd.).

The specific examples of the mold release agent for the toner of this embodiment include, for example, low molecular weight polyolefins such as various ester waxes, polyethylene, polypropylene, and polybutene; silicones that show a softening temperature by heating; fatty acid amides such as oleic acid amide, erucic acid amide, ricinoleic acid amide, stearic acid amide; vegetable wax such as carnauba wax, rice wax, candelilla wax, Japan wax, and jojoba oil; animal wax such as bees wax; mineral and petroleum waxes such as montan wax, ozokerite, ceresine, paraffin wax, microcrystalline wax, and Fischer-Tropsch wax; and modified products of them. These waxes hardly dissolved in a solvent such as toluene around room temperature, or only traces of the waxes are dissolved. These waxes are dispersed in water with a polymeric electrolyte such as an ionic surfactant, a polymeric acid, and a polymeric base, and are heated to equal to or more than a melting point. The heated waxes are dispersed to be in a particle shape by a homogenizer and a pressure discharge disperser (Gaulin Homogenizer, manufactured by Gaulin Corporation), which provide high shear forces. This manufactures a dispersion liquid with a particle size equal to or smaller than a size of a submicron particle. The obtained particle diameter of the mold release agent-containing dispersion liquid can be measured by, for example, a laser diffraction particle size analyzer (LA-920, manufactured by Horiba, Ltd.).

These specific examples of the mold release agent are preferred to be added in a range from 5 to 25 wt % of whole weight of solid composing the toner, in order to ensure peel property of a fixed image in an oilless fixing system.

In the case where the above-described mold release agent is used, a resin particle, a colorant particle, and a mold release agent particle are aggregated. Subsequently, the resin particle dispersion liquid is further added so as to attach the resin particle to surfaces of the aggregated particles. This is preferred from the aspect of ensuring charging property and durability.

A magnetic material may be added to provide magnetism to the toner. Specifically, the magnetic material employs a material to be magnetized in a magnetic field. A ferromagnetic powder such as iron, cobalt, nickel, or a compound such as ferrite and magnetite are used. When a toner is obtained in an aqueous medium in this embodiment, it should be paid attention to aqueous phase transition of the magnetic material. It is preferred that a surface of the magnetic material be preliminarily modified and treated by hydrophobization treatment.

The toner may contain a small amount of charge controlling agent to efficiently give an electric charge. The charge controlling agent employs various charge controlling agents, which are usually used, such as: dye including a complex of quaternary ammonium salt compound, nigrosine compound, aluminum, iron, and chrome; and a triphenylmethane pigment. A preferred material is not easily dissolved in water from the viewpoints of controlling of ion intensity, which affects stabilization in aggregation or coalescence, and reduction of wastewater contamination.

The toner may contain a polarity controlling agent to make a charged polarity a predetermined polarity. The polarity controlling agent employs, for example, a metal complex salt of monoazo dye; metal complexes of Co, Cr, or Fe with nitrohumic acid and its salt, salicylic acid, naphthoic acid, and dicarboxylic acid; organic dye; and quaternary ammonium salt.

An inorganic particulate may be added to a toner as additive. The inorganic particulate may employ silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, silicon nitride, and similar material. Among thise, two kinds of these materials, which are silica and titanium oxide, especially provide significant effects of preventing the additive from being buried in the toner and stabilizing the charge of the toner.

An exemplary surfactant is used for, for example, polymerization; dispersion of pigment; manufacturing or dispersion of a resin particle; dispersion, aggregation, or stabilization of a mold release agent. This surfactant employs: an anionic surfactant such as sulfate ester salt series, sulfonate salt series, phosphate ester series, and soap series; a cationic surfactant such as an amine salt type and a quaternary ammonium salt type; a nonionic surfactant such as polyethylene glycol series, alkylphenol ethylene oxide adduct series, and polyhydric alcohol series, in combination, which is effective. Means for dispersion employs general means such as a rotary shearing type homogenizer and ball mill having a medium, sand mill having a medium, and dyno mill having a medium.

Next, a carrier used in this embodiment will be described.

The carrier includes a magnetic nucleus particle where a coating layer is formed. The nucleus particle of the carrier employs ferromagnetic metal such as iron, cobalt, and nickel and alloy such as magnetite, hematite, and ferrite, and their compounds.

The resin to form the coating layer of the carrier may employ, for example, polyolefin resin such as polyethylene, polypropylene, chlorinated polyethylene, and chlorosulfonated polyethylene; polyvinyl and polyvinylidene resin such as polystyrene, acrylic resin (such as polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; vinyl chloride/vinyl acetate copolymer; styrene/acrylic acid copolymer; silicone resin like straight silicone resin including organosiloxane bond or its modified product (such as a modified products of alkyd resin, polyester, epoxy resin, and polyurethane); fluorine resin such as polytetrafluoroethylene, polyvinyl fluoride, polyvinylidene fluoride, and polychlorotrifluoroethylene; polyamide; polyester such as polyethylene terephthalate; polyurethane; polycarbonate; amino resin such as urea-formaldehyde resin; epoxy resin. Among these resins, acrylic resin, silicone resin or its modified product, and fluorine resin are preferred to prevent toner spent (especially, silicon resin or its modified product are preferred). A method for forming the coating layer employs a method for applying resin over a surface of the carrier nucleus particle using a spray method or a soaking method.

Regarding the carrier, fine powders may be added in the coating layer to adjust carrier resistance, for example. The fine powders, which are dispersed in the coating layer, are preferred to have particle diameters of approximately 0.01 to 5.0 μm. Also, the fine powders are preferred to be added to 100 weight parts of coating resin by 2 to 30 weight parts (especially, 5 to 20 weight parts). The fine powders may employs metal oxide such as silica, alumina, and titania and pigment such as carbon black.

Next, a description will be given of a method for producing a K-color toner according to this embodiment and a method for producing a developer including the K-color toner and a carrier.

(Measurement of Molecular Weight of a Resin Particle)

Gel permeation chromatography (GPC) measured a weight average molecular weight Mw and the number average molecular weight Mn under the following condition. At a temperature of 40° C., a solvent (tetrahydrofuran) flows at a flow rate of 1.2 ml per minute. A measurement was carried out by pouring a tetrahydrofuran sample solution in a concentration of 0.2 g/20 ml with a sample weight of 3 mg. In molecular weight measurement of the sample, a monodispersed polystyrene standard sample with several kinds of molecular weights of the sample was used. Then, a measuring condition was selected within a range where logarithms of the molecular weight and count numbers of a generated calibration curve were in a straight line. Here, reliability of the measurement result can be verified by showing that NBS 706 polystyrene standard sample, which was measured under the above-described measuring condition, has the weight average molecular weight Mw of $28.8\times10^4$ and the number average molecular weight Mn of $13.7\times10^4$. A column of the above-described GPC employed, for example, TSK-GEL, GMH (which is manufactured by TOSOH CORPORATION) that satisfies the above-described condition.

(Measurement of a Glass-Transition Temperature Tg of Resin)

A glass-transition temperature Tg of resin was measured by a differential scanning calorimetry DSC/RDC220 (which is manufactured by Seiko Instruments Inc.). A particle diameter of a resin particle in resin particle dispersion liquid was measured by a laser diffraction particle size analyzer (LA-920, manufactured by Horiba, Ltd.). Particle diameters of toner particle, carrier particle, and recording agent were measured by Coulter Multisizer TA-II (which is manufactured by Beckman Coulter, Inc.).

(Production of Resin Particle Dispersion Liquid (1))

A resin dispersion liquid (1) including ethylenically unsaturated compound polymer was produced as follows. First, 300 weight parts of ion exchanged water and 1.5 weight parts of TTAB (tetradecyltrimethylammonium bromide, which is manufactured Sigma Chemical Co., Ltd.) were prepared in a separable flask. Subsequently, nitrogen replacement was performed for 20 minutes. The liquid in the flask was heated to 65° C. while being stirred. Subsequently, 40 weight parts of n-butyl acrylate monomer was added, and the liquid was further stirred for 20 minutes. Then, 0.5 weight parts of polymerization initiator V-50 (2,2'-azobis(2-methylpropionamidine)dihydrochloride, manufactured by Wako Pure Chemical Industries, Ltd.) was preliminarily dissolved in 10 weight parts of the ion exchanged water, and then added in the flask. The liquid was kept at 65° C. for three hours. Subsequently, emulsified liquid was continuously added into the flask for two hours using a metering pump. The emulsified liquid contained 61 weight parts of styrene monomer, 9 weight parts of n-butyl acrylate monomer, 2 weight parts of acrylic acid, and 0.8 weight parts of dodecanethiol that were emulsified in 100 weight parts of ion exchanged water where 0.5 weight parts of TTAB was dissolved. Subsequently, the temperature was heated to 70° C. and kept for two hours, thus completing the polymerization. This polymerization provided core-shell resin particle dispersion liquid (1) with a weight average molecular weight Mw of 25,000, an average particle diameter of 150 nm, a solid compound of 25 wt %. After the resin particle was dried in air at 40° C., when DSC analysis was performed in a temperature range from −80° C. to 140° C., a glass transition by polybutylacrylate was observed at around −50° C. At around 60° C., a glass transition of resin by copolymer, which was considered to composed of styrene-butylacrylate-acrylic acid copolymer, was observed.

(Compounding of Colorant Particle Dispersion Liquid (C1))

Compounding of colorant particle dispersion liquid (C1) was performed as follows. Here, a description will be given of an exemplary compounding of the colorant particle dispersion liquid that is colorant particle dispersion liquid (C1) corresponding to cyan. Components of: 100 weight parts of cyan pigment (copper phthalocyanine C.I. Pigment Blue 15:3, manufactured by Dainichiseika Color & Chemicals Mfg. Co., Ltd.); 10 weight parts of anionic surfactant (Neogen R, manufactured by DAI-ICHI KOGYO SEIYAKU CO., LTD.); and 400 weight parts of ion exchanged water were mixed and dissolved. This mixture was dispersed for 15 minutes by a homogenizer (Ultra Turrax, manufactured by IKA CO.), and then dispersed for 10 minutes in an ultrasonic wave bath. Thus, cyan colorant particle dispersion liquid with the center diameter of 210 nm and a solid compound of 21.5% was obtained.

(Compounding of a Mold Release Agent-Containing Dispersion Liquid (R1))

Compounding of a mold release agent-containing dispersion liquid (R1) was performed as follows.

Components of: 2 weight parts of anionic surfactant (Neogen R, manufactured by DAI-ICHI KOGYO SEIYAKU CO., LTD.); and 215 weight parts of carnauba wax were mixed with 800 weight parts of ion exchanged water, and melted by being heated to 100° C. Subsequently, the mixture was emulsified for 15 minutes by a homogenizer (Ultra Turrax, manufactured by IKA CO.), and additionally emulsified using Gaulin Homogenizer at 100° C. This allowed obtaining a mold release agent-containing dispersion liquid with the particle center diameter of 230 nm, a melting point of 83° C., and a solid compound of 21.5%.

(Compounding and Production of a K-Color Toner (1))

Using the various dispersion liquids compounded as described above, a K-color toner (1) was produced as follows. Components of: 168 weight parts (42 weight parts of resin) of resin particle dispersion liquid (1); 40 weight parts (8.6 weight parts of pigment) of colorant particle dispersion liquid (C1); 80 weight parts (17.2 weight parts of mold release agent) of mold release agent-containing dispersion liquid (R1); 0.15 weight parts of polyaluminum chloride; and 300 weight parts of ion exchanged water were sufficiently mixed and dispersed in a round stainless flask by a homogenizer (Ultra Turrax T50, manufactured by IKA CO.). Subsequently, a content of the flask was heated to 42° C. in a heating oil bath while being stirred, and kept at 42° C. for 60 minutes. Subsequently, 84 weight parts (21 weight parts of resin) of the resin particle dispersion liquid (1) were added, and the mixture was slowly stirred. After pH within the system was adjusted to 6.0 using 0.5 mol/L sodium hydroxide aqueous solution, the mixture was heated to 95° C. while being stirred. Here, sodium hydroxide aqueous solution was additionally dropped, and the mixture was kept at 95° C. for three hours not to have pH equal to or less than 5.5. After a reaction terminated, cooling, filtering, and sufficient cleaning with ion exchanged water were performed. Subsequently, solid-liquid separation was performed by Nutsche suction filtration. The separated material was then dispersed in ion exchanged water at 40° C. again, and stirred and cleaned for 15 minutes at 300 rpm. This cleaning operation was repeated five times, and solid-liquid separation was performed by Nutsche suction filtration. Subsequently, vacuum drying was performed for 12 hours. Thus, a K-color toner particle (1) was obtained. When a particle diameter of this toner particle was measured by a Coulter counter, a volume average particle diameter was 5.8 μm.

Subsequently, 1.5 weight parts of hydrophobic silica (TS720, manufactured by Cabot Corporation) was added to 50 weight parts of the above-described toner. With mixing with a sample mill, a K-color toner (1) was obtained.

(Compounding of Developer (1))

A homomixer disperse: 100 weight parts of silicone resin solution (KR50, manufactured by Shin-Etsu Chemical Co., Ltd); 3 weight parts of carbon black (BP2000, manufactured by Cabot Corporation), and 100 weight parts of toluene for 30 minutes. Thus, a coating layer forming solution was prepared. Using this coating layer forming solution and 1000 weight parts of a spherical ferrite carrier with an average particle diameter of 50 μm, a carrier where a coating layer was formed on a surface of the spherical ferrite carrier was manufactured by a fluidized bed coater. Subsequently, 90 weight part of the above-described toner and 910 weight parts of the above-described carrier were stirred in the ball mill for 30 minutes. Thus, the developer (1) was produced.

(Production of a Resin Particle Dispersion Liquid (2))

A resin particle dispersion liquid (2) containing polyester resin was produced as follows. Materials of: 175 weight parts of 1,4-cyclohexanedicarboxylic acid; 320 weight parts of two mol ethylene oxide adducts of bisphenol A; and 0.5 weight parts of dodecylbenzenesulfonic acid were mixed. Subsequently, these mixed materials were introduced to a reactor with a stirrer. Polycondensation was performed at 120° C. for 12 hours under nitrogen atmosphere. This obtains a uniform transparent polyester resin (1). A weight average molecular weight was 14,000 measured by GPC, and Tg was 54° C. measured by DSC. Materials of: 0.36 weight parts of dodecylbenzenesulfonic acid; 80 weight parts of 1,6-hexanediol; and 115 weight parts of sebacic acid were mixed and introduced to a reactor with a stirrer. Polycondensation was performed at 90° C. for 5 hours under nitrogen atmosphere. Then, a uniform white polyester resin (2) was obtained. A weight average molecular weight was 8,000 measured by GPC, and Tg was −52° C. measured by DSC.

Materials of 100 weight parts of the polyester resin (1) and 100 weight parts of the polyester resin (2), which were obtained in the above-described polycondensations, were introduced to a reactor with a stirrer, and dissolved and mixed at 120° C. for 30 minutes. Subsequently, 1.0 weight parts of dodecylbenzenesulfonic acid sodium and 1.0 weight parts of 1N NaOH aqueous solution were dissolved in 800 weight parts of ion exchanged water that was heated to 95° C. as a neutralizing aqueous solution. The neutralizing aqueous solution was added into a flask. Emulsification was performed for five minutes by a homogenizer (Ultra Turrax, manufactured by IKA CO.). Additionally, after shaking for 10 minutes in an ultrasonic wave bath, the flask was cooled by room temperature water. Thus, the resin particle dispersion liquid (2) with a solid compound of 20 wt % was obtained, and its resin particle has the center diameter of 250 nm.

(Compounding and Production of K-Color Toner (2))

Using various dispersion liquids compounded as described above, a toner (2) was produced as follows. According to a combination of: 210 weight parts (42 weight parts of resin) of the resin particle dispersion liquid (2); 40 weight parts (8.6 weight parts of colorant) of the colorant particle dispersion liquid (C1); 40 weight parts (8.6 weight parts of mold release agent) of the mold release agent-containing dispersion liquid (R1); 0.15 weight parts of polyaluminum chloride; and 300 weight parts of ion exchanged water, these components were sufficiently mixed and dispersed in a round stainless flask by a homogenizer (Ultra Turrax T50, manufactured by IKA CO.). Subsequently, a content of the flask was heated to 42° C. in a heating oil bath while being stirred, and kept at 42° C. for 60 minutes. Subsequently, 105 weight parts (21 weight parts of resin) of the resin particle dispersion liquid (2) were added, and the mixture was slowly stirred. After pH within the system was adjusted to 6.0 using 0.5 mol/L sodium hydroxide aqueous solution, the mixture was heated to 95° C. while being stirred. Until the mixture reaches 95° C., a sodium hydroxide aqueous solution was additionally dropped so as not to have pH equal to or less than 5.0. The mixture was kept at 95° C. for three hours. After a reaction terminated, cooling, filtering, and sufficient cleaning with ion exchanged water were performed. Subsequently, solid-liquid separation was performed by Nutsche suction filtration. The separated material was then dispersed in three liters of ion exchanged water at 40° C. again, and stirred and cleaned for 15 minutes at 300 rpm. This cleaning operation was repeated five times, and solid-liquid separation was performed by Nutsche suction filtration. Subsequently, vacuum drying was performed for 12 hours. Thus, a toner particle was obtained. When a particle diameter of this toner particle was measured by a Coulter counter, a volume average particle diameter was 4.9 μm.

Subsequently, 1.5 weight parts of hydrophobic silica (TS720, manufactured by Cabot Corporation) was added to 50 weight parts of the above-described toner. With mixing with a sample mill, a K-color toner (2) was obtained.

(Compounding of Developer (2))

A homomixer disperse: 100 weight parts of silicone resin solution (KR50, manufactured by Shin-Etsu Chemical Co., Ltd); 3 weight parts of carbon black (BP2000, manufactured by Cabot Corporation), and 100 weight parts of toluene for 30 minutes. Thus, a coating layer forming solution was prepared. Using this coating layer forming solution and 1000 weight parts of a spherical ferrite carrier with an average particle diameter of 50 μm, a carrier where a coating layer was formed on a surface of the spherical ferrite carrier was manufactured by a fluidized bed coater. Subsequently, 90 weight part of the above-described toner and 910 weight parts of the above-described carrier were stirred in the ball mill for 30 minutes. Thus, a developer (2) was produced.

The description above is exemplary. The present invention has specific advantageous effects by aspects of (1) to (6) as follows.

(1)

An image forming apparatus includes a plurality of housing units that houses toners of mutually different colors. The image forming apparatus forms a toner image on a recording medium such as a recording sheet P using at least one toner inside of the plurality of housing units. The image forming apparatus fixes the toner image on the recording medium to the recording medium with a fixing unit such as the fixing device 40. A housing unit among the plurality of housing units houses a toner with a lowest peak temperature of loss elastic modulus. This housing unit is disposed in a portion with a lower temperature than a temperature of a portion where another housing unit is disposed.

As described in the embodiment, this configuration prevents the toner from condensing inside of the housing unit that houses the toner with the low peak temperature of loss elastic modulus.

(2)

An image forming apparatus includes a plurality of housing units that houses toners of mutually different colors. The image forming apparatus forms a toner image on a recording medium such as a recording sheet P using at least one toner inside of the plurality of housing units. The image forming apparatus fixes the toner image on the recording medium to the recording medium with a fixing unit such as the fixing device 40. A housing unit among the plurality of housing units houses a toner with a lowest peak temperature of loss elastic modulus. This housing unit is disposed in a position farther from the fixing unit than a position where another housing unit is disposed.

As illustrated in FIG. 5 and FIG. 7, this configuration suppresses temperature of the housing unit as the distance from the fixing device becomes larger. The housing unit, which houses the toner with the lowest peak temperature of loss elastic modulus, is disposed in the position farther from the fixing unit than the portion where the other housing unit is disposed. This suppresses the temperature of the housing unit that houses the toner with the lowest peak temperature of loss elastic modulus compared with a temperature of another housing unit.

(3)

According to the aspect of the image forming apparatus described in (1), the housing unit that houses the toner with the lowest peak temperature of loss elastic modulus is disposed in a position farther from the fixing unit than a portion where another housing unit is disposed. This configuration suppresses the temperature of the housing unit that houses the toner with the lowest peak temperature of loss elastic modulus compared with a temperature of another housing unit.

(4)

According to the aspect of the image forming apparatus described in any one of (1) to (3), the housing unit is a developing device 4, which houses a toner, and/or a toner container such as the toner bottle 103, which houses a toner to be replenished to the developing device 4. The developing device develops a latent image on a latent image carrier such as photosensitive element 3 using toner.

This configuration prevents the toner from condensing inside of the developing device 4 and the toner bottle.

(5)

According to the aspect of the image forming apparatus described in any one of (1) to (4), a fixing temperature of the fixing unit when an image is formed using the toner with the lowest peak temperature of loss elastic modulus only is lower than a fixing temperature when an image is formed using the other toner.

This configuration reduces consumption energy when an image is formed using the toner with the lowest peak temperature of loss elastic modulus only.

(6)

According to the aspect of the image forming apparatus described in any one of (1) to (5), the toner with the lowest peak temperature of loss elastic modulus is a black toner.

This configuration saves energy in the monochrome image forming mode.

(7)

According to the aspect of the image forming apparatus described in any one of (1) to (6), the toner with the lowest peak temperature of loss elastic modulus includes at least crystal polyester.

Inclusion of crystalline polyester provides an excellent low temperature fixing characteristic and ensures a toner with high sharp melting property. In view of this, forming an image with this toner allows fixing at a low fixing temperature. This also ensures a satisfactory fixing characteristic.

With the present invention, the housing unit where the toner with a low peak temperature of loss elastic modulus is housed is disposed in a portion where a temperature is decreased compared with a portion where another housing unit is disposed. This prevents the toner from condensing inside of the housing unit compared with a case where the housing unit that houses the toner with a low peak temperature of loss elastic modulus is disposed in a portion where a temperature increases similarly or more than a temperature of the other housing unit. This prevents blocking from occurring.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of housing units configured to house toners of mutually different colors, at least one toner inside of the plurality of housing units being configured to form a toner image on a recording medium; and a fixing unit configured to fix the toner image to the recording medium, wherein a housing unit among the plurality of housing units, a toner including a relatively lowest peak temperature of loss elastic modulus being disposed in a portion of the housing unit including a relatively lower temperature than a temperature of another portion where another housing unit among the plurality of housing units is disposed.

2. The image forming apparatus according to claim 1, wherein the housing unit that houses the toner with the relatively lowest peak temperature of loss elastic modulus is relatively farther from the fixing unit than the other portion where the another housing unit is disposed.

3. The image forming apparatus according to claim 1, wherein the housing unit is at least one of a developing device and a toner container, the developing device housing a toner, the developing device being configured to develop a latent image on a latent image carrier using toner, and the toner container housing a toner to be replenished to the developing device.

4. The image forming apparatus according to claim 3, further comprising a toner hopper above the developing device, the toner hopper being configured to temporarily store the toner.

5. The image forming apparatus according to claim 4, further comprising a tube connecting the toner container and the developing device via the toner hopper.

6. The image forming apparatus of claim 3, further comprising a screw pump connectingly located being the toner container and the developing device.

7. The image forming apparatus according to claim 1, wherein a fixing temperature of the fixing unit when an image is formed using the toner with the relatively lowest peak temperature of loss elastic modulus is relatively lower than a fixing temperature when an image is formed using another toner.

8. The image forming apparatus according to claim 1, wherein the toner with the relatively lowest peak temperature of loss elastic modulus is a black toner.

9. The image forming apparatus according to claim 1, wherein the toner with the relatively lowest peak temperature of loss elastic modulus includes at least crystal polyester.

10. An image forming apparatus comprising:

a plurality of housing units configured to house toners of mutually different colors, at least one toner inside of the plurality of housing units being configured to form a toner image on a recording medium; and a fixing unit configured to fix the toner image to the recording medium, wherein a housing unit among the plurality of housing units, a toner with a relatively lowest peak temperature of loss elastic modulus being disposed relatively farther from the fixing unit than a portion where another housing unit among the plurality of housing units is disposed.

11. The image forming apparatus according to claim 10, wherein the housing unit is at least one of a developing device and a toner container, the developing device housing a toner, the developing device being configured to develop a latent image on a latent image carrier using the toner, and the toner container housing a toner to be replenished to the developing device.

12. The image forming apparatus according to claim 11, further comprising a toner hopper above the developing device, the toner hopper being configured to temporarily store the toner.

13. The image forming apparatus according to claim 12, further comprising a tube connecting the toner container and the developing device via the toner hopper.

14. The image forming apparatus of claim 11, further comprising a screw pump connectingly located being the toner container and the developing device.

15. The image forming apparatus according to claim 10, wherein a fixing temperature of the fixing unit, when an image is formed using the toner with the relatively lowest peak temperature of loss elastic modulus, is relatively lower than a fixing temperature when an image is formed using another toner.

16. The image forming apparatus according to claim 10, wherein the toner with the relatively lowest peak temperature of loss elastic modulus is a black toner.

17. The image forming apparatus according to claim 10, wherein the toner with the relatively lowest peak temperature of loss elastic modulus includes at least crystal polyester.

* * * * *